US009633642B2

(12) United States Patent
Yukawa et al.

(10) Patent No.: US 9,633,642 B2
(45) Date of Patent: Apr. 25, 2017

(54) ELECTRONIC MUSICAL INSTRUMENT SYSTEM

(71) Applicant: ROLAND CORPORATION, Shizuoka (JP)

(72) Inventors: Atsuo Yukawa, Shizuoka (JP); Atsushi Hoshika, Shizuoka (JP); Hirofumi Yui, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 0 days.

(21) Appl. No.: 14/807,890

(22) Filed: Jul. 24, 2015

(65) Prior Publication Data

US 2017/0025112 A1 Jan. 26, 2017

(51) Int. Cl.

| | |
|---|---|
| ***A63H 5/00*** | (2006.01) |
| ***G04B 13/00*** | (2006.01) |
| ***G10H 7/00*** | (2006.01) |
| ***G10H 7/02*** | (2006.01) |
| ***G10H 1/00*** | (2006.01) |

(52) U.S. Cl.

CPC ..... *G10H 7/002* (2013.01); *G10H 1/0058* (2013.01); *G10H 7/02* (2013.01); *G10H 2220/091* (2013.01); *G10H 2230/045* (2013.01); *G10H 2240/161* (2013.01)

(58) Field of Classification Search

CPC ..... G10H 7/002; G10H 7/02; G10H 1/0058; G10H 2240/161; G10H 2230/045; G10H 2220/091

USPC ..... 84/609

See application file for complete search history.

(56) References Cited

U.S. PATENT DOCUMENTS 5,657,221 A 8/1997 Warman et al.
5,808,221 A 9/1998 Ashour et al.

FOREIGN PATENT DOCUMENTS

JP 2005-196077 7/2005

OTHER PUBLICATIONS

Create Digital Music, http://createdigitalmusic.com/2014/07/heres-sh-101-reborn-aira-plug-sounds/, retrieved on Jul. 23, 2015, "Hands-on: How the SH-101 Plug-Out for Aira System-1 Works—and Sounds—Create Digital Music".

Roland Corporation, http://www.roland.com/products/vc-1/, retrieved on Jul. 23, 2015, "Roland—VC-1_D-50 V-Card for V-Synth".

*Primary Examiner* — Jeffrey Donels

(74) *Attorney, Agent, or Firm* — Jianq Chyun IP Office

(57) ABSTRACT

Provided is an electronic musical instrument system. A PC is configured to perform an operation of emulating an analog synthesizer by a first software synthesizer. The PC installs a second software synthesizer to a hardware synthesizer on condition that the hardware synthesizer is confirmed to be the device corresponding to the second software synthesizer. The hardware synthesizer performs the operation of emulating the analog synthesizer by the second software synthesizer. The first software synthesizer and the second software synthesizer related to the operation of emulating the analog synthesizer have the same function respectively, and are capable of generating the same tone respectively, the effect of reproducing the same function and tone as the synthesizer that is to be emulated can be achieved respectively in two different devices, i.e. the PC and the hardware synthesizer.

16 Claims, 11 Drawing Sheets

ELECTRONIC MUSICAL INSTRUMENT SYSTEM

BACKGROUND OF THE INVENTION

Field of the Invention

The invention relates to an electronic musical instrument system and particularly relates to an electronic musical instrument system capable of reproducing the same function and tone as an electronic musical instrument, which is to be emulated, respectively in two different devices.

Description of Related Art

Conventionally, emulation software for emulating the operation of the existing synthesizers has been known. The emulation software is a software synthesizer that is incorporated into a general-purpose computer, e.g. a personal computer (referred to as "PC" hereinafter) to emulate the operation of a synthesizer, i.e. the target to be emulated, in the PC.

However, the PC is not equipped with the general-purpose operating elements (e.g. sliders and dials) of the existing synthesizers. Therefore, for the PC, it is necessary to use the mouse and keyboard to input the specified information, which is disadvantageous in operability compared with the existing synthesizers that are to be emulated.

Accordingly, a technique called control surface is disclosed in the following Patent Literature 1. The control surface is provided with a controller that has an operation panel having the same arrangement as the operation panel of the synthesizer to be emulated. The controller is connected to the PC with the emulation software incorporated therein and inputs a control signal corresponding to the setting position of each operating element of the controller to the PC. The PC converts the control signal inputted from the controller into a setting parameter and sets the state of a sound source in accordance with the setting parameter. Since the control surface can be operated by using the operation panel that has the same arrangement as the operation panel of the synthesizer to be emulated, the control surface has good operability. However, to use the control surface, the controller and the PC need to be connected. Thus, it is required to carry both the controller and the PC, which is inconvenient.

On the other hand, apart from the control surface, the following system is known. Such a system incorporates the emulation software into another synthesizer (referred to as a "hardware synthesizer" hereinafter) different from the synthesizer to be emulated and enables the hardware synthesizer to emulate the operation of the synthesizer to be emulated in addition to the original operation of the hardware synthesizer.

Since the operation of the synthesizer to be emulated can be emulated using the operating element of the hardware synthesizer, this system is favorable in operability. In addition, this system can emulate the operation of the synthesizer to be emulated with one single hardware synthesizer without connection to the PC and therefore is convenient to carry.

PRIOR ART LITERATURE

Patent Literature

[Patent Literature 1] Japanese Patent Publication No. 2005-196077

SUMMARY OF THE INVENTION

Problem to be Solved

However, the system that incorporates the emulation software into the hardware synthesizer faces the problem that it cannot emulate the operation of the synthesizer to be emulated by a PC.

That is, this system cannot meet the demands of music producers, such as emulating the operation of the synthesizer to be emulated by using the PC at home and emulating the operation of the synthesizer to be emulated by using the hardware synthesizer in the studio.

On the other hand, it has been considered to incorporate the emulation software into the hardware synthesizer and the PC respectively, so as to meet these demands. However, conventionally, the emulation software for the hardware synthesizer and the emulation software for the PC are made separately and independently and are not coordinated with each other.

Therefore, for example, a certain parameter may be inputted by the emulation software incorporated into the hardware synthesizer but cannot be inputted by the emulation software incorporated into the PC. Moreover, for a certain parameter, the range of the level that can be inputted by the emulation software for the hardware synthesizer may be 1-10 while the range may only be 1-5 in the emulation software for the PC. In addition, in the case where the circuit configuration of the synthesizer to be emulated is replaced with software by the respective emulation software, the configurations do not coincide and the specific operation modes also differ (e.g. different filter characteristics). Consequently, the same sound quality may not be obtained.

In other words, the hardware synthesizer and the PC may not reproduce the same function and tone of the synthesizer to be emulated.

The invention relates to an electronic musical instrument system and particularly provides an electronic musical instrument system that is capable of reproducing the same functions and tones as the electronic musical instruments to be emulated respectively in two different devices.

Solution to the Problem and Effect of the Invention

The electronic musical instrument system achieves the following effects. An information processing device and an electronic musical instrument device are connected to communicate with each other via a connection means, wherein the information processing device includes a first computing means, a display means displaying an image, a first input means inputting first input information via the image displayed by the display means, and first emulation software enabling the first computing means to emulate a predetermined electronic musical instrument comprising a plurality of input means based on the first input information inputted by the first input means; and the electronic musical instrument device includes a second computing means, at least one second input means inputting second input information via an operating element that is the same type as an operating element of a general-purpose electronic musical instrument, and non-emulation software enabling the second computing means to operate as an electronic musical instrument different from the predetermined electronic musical instrument based on the second input information inputted by the second input means. The information processing device combines and stores the first emulation software and second emulation software, which enables the second computing means to emulate the predetermined electronic musical instrument based on the second input information inputted by the second input means, in a first storage means; confirms whether the electronic musical instrument device corresponding to the second emulation software stored in the first storage means is connected to the information processing device via the connection means by a confirmation means; and transfers the second emulation software stored in the first storage means to the electronic musical instrument device by a transfer means if the connection is confirmed by the confirmation means. Therefore, the second emulation software can be transferred to the electronic musical instrument device corresponding to the second emulation software. In addition, since the first emulation software and the second emulation software are related to the emulation of the predetermined electronic musical instrument, have the same function respectively, and are configured to generate the same tone respectively, the effect of reproducing the same function and tone as the predetermined electronic musical instrument that is to be emulated can be achieved respectively in two different devices, i.e. the information processing device and the electronic musical instrument device.

Furthermore, the emulation of the predetermined electronic musical instrument is to configure first and second software synthesizers and operate the first and second computing means to make a musical sound processing algorithm including an electronic circuit configuration or the control reaction mode and output method similar to those of the predetermined electronic musical instrument.

The electronic musical instrument system achieves the following effects. The information processing device includes a first transmission means, which transmits the first input information inputted by the first input means to the electronic musical instrument device via the connection means, wherein the electronic musical instrument device transfers the second emulation software. The electronic musical instrument device transferring the second emulation software includes a second transmission means, which transmits the second input information inputted by the second input means to the information processing device via the connection means. The first emulation software enables the first computing means to emulate the predetermined electronic musical instrument based on the second input information transmitted by the second transmission means. The second emulation software enables the second computing means to emulate the predetermined electronic musical instrument based on the first input information transmitted by the first transmission means. Therefore, the tone of the musical sound generated in the information processing device can be changed by operating the second input means of the electronic musical instrument device, and the tone of the musical sound generated in the electronic musical instrument device can be changed by operating the first input means of the information processing device.

The electronic musical instrument system achieves the following effects. The information processing device prohibits the first input information inputted via the first input means from being transmitted to the electronic musical instrument device by the first transmission means by a first prohibiting means; and the electronic musical instrument device prohibits the second input information inputted via the second input means from being transmitted to the information processing device by the second transmission means by a second prohibiting means. Therefore, the information processing device and the electronic musical instrument device can respectively function alone. Accordingly, the effect of comparing the musical sound information generated by the information processing device and the musical sound information generated by the electronic musical instrument device to select the better musical sound information, for example, can be achieved.

The electronic musical instrument system achieves the following effects. The information processing device includes a second storage means, which stores musical sound information generated by the first emulation software or a parameter related to a tone; and when a transmission instruction is inputted by a first transmission instruction means, the musical sound information or the parameter related to the tone stored in the second storage means is transmitted from the information processing device to the electronic musical instrument device. Therefore, the musical sound information generated by the first emulation software can also be used to produce music in the electronic musical instrument device, like the case of using the musical sound information stored in the second storage means to produce music in the information processing device.

The electronic musical instrument system achieves the following effects. The electronic musical instrument device includes a third storage means, which stores musical sound information generated by the second emulation software or a parameter related to a tone; and when a transmission instruction is inputted by a second transmission instruction means, the musical sound information or the parameter related to the tone stored in the third storage means is transmitted from the electronic musical instrument device to the information processing device. Therefore, the musical sound information generated by the second emulation software can also be used to produce music in the information processing device, like the case of using the musical sound information stored in the third storage means to produce music in the electronic musical instrument device.

The electronic musical instrument system achieves the following effects. The first and second input information respectively inputted by the first input means and the second input means is respectively limited to the same range. Therefore, the effect of reproducing the same tone as the predetermined electronic musical instrument that is to be emulated can be achieved respectively in two different devices, i.e. the information processing device and the electronic musical instrument device.

The electronic musical instrument system achieves the following effects. The at least one second input means which is a plurality of second input means is disposed; the second emulation software enables the second computing means to operate based on the second input information inputted from a portion of the plurality of second input means; and the electronic musical instrument device distinguishably notifies the portion of the second input means and the other second input means by a notification means when the second computing means is enabled to operate by the second emulation software. Since the user can recognize the second input means that is to be used when the second computing means is enabled to operate by the second emulation software, for the user, it is easily manageable.

The electronic musical instrument system achieves the following effects. The first input means displays an image, which emulates at least a portion of the input means of the predetermined electronic musical instrument, on the display means. Therefore, the user may feel like operating the predetermined electronic musical instrument when operating the first input means.

The electronic musical instrument system achieves the following effects. The first input means displays an image, which emulates at least a portion of the second input means of the electronic musical instrument device, on the display means. Since the user feels the same in operating the first input means and the second input means, for the user, it is easily manageable.

The electronic musical instrument system achieves the following effects. A switching means is provided for switching between a mode of enabling the second computing means to operate by the non-emulation software and a mode of enabling the second computing means to operate by the second emulation software. Therefore, two different modes can be executed in one device, i.e. the electronic musical instrument device.

The electronic musical instrument system achieves the following effects. The second input information transmitted from the electronic musical instrument device by the second transmission means is removed from information transmitted to the electronic musical instrument device via the connection means from the first input information inputted by the first input means. Therefore, looping of input information, which occurs when the input information transmitted from the electronic musical instrument device to the information processing device is transmitted again to the electronic musical instrument device, can be prevented.

The electronic musical instrument system achieves the following effects. The first input information transmitted from the information processing device by the first transmission means is removed from the second input information inputted by the second input means, which the electronic musical instrument device transmits to the information processing device via the connection means. Therefore, looping of input information, which occurs when the input information transmitted from the information processing device to the electronic musical instrument device is transmitted again to the information processing device, can be prevented.

The electronic musical instrument system achieves the following effects. The first emulation software includes plug-in software, which enables the first computing means to emulate the predetermined electronic musical instrument, or a software synthesizer, which enables the first computing means to emulate the predetermined electronic musical instrument. Therefore, there is no need to prepare an additional exclusive hardware circuit, and the information processing device can emulate the predetermined electronic musical instrument simply by incorporating such software into the information processing device.

The electronic musical instrument system achieves the following effects. The non-emulation software enables the electronic musical instrument device to operate as an independent electronic musical instrument different from the predetermined electronic musical instrument and an existing electronic musical instrument. Therefore, the electronic musical instrument device can operate as an independent electronic musical instrument device or as an electronic musical instrument device that emulates the predetermined electronic musical instrument.

The electronic musical instrument system achieves the following effects. The second input means of the electronic musical instrument device is configured to be different from the input means of the predetermined electronic musical instrument in any of form, configuration, and number. Therefore, despite that the electronic musical instrument device may be used to emulate the predetermined electronic musical instrument, when it is operated as the original electronic musical instrument device, the input information can be inputted by the input means corresponding to the original electronic musical instrument device. Hence, it is easy to operate.

The electronic musical instrument system achieves the following effects. The electronic musical instrument device includes a non-volatile fourth storage means, which stores the second emulation software transferred by the transfer means. Therefore, once the second emulation software is stored, it is possible to continue storing the second emulation software thereafter even if the electronic musical instrument device has no power supply or the power supply is turned off. Accordingly, it is not required to obtain the second emulation software whenever the power supply of the electronic musical instrument device is lost or the power supply is turned off. The second emulation software can be used efficiently to achieve emulation of the predetermined electronic musical instrument.

BRIEF DESCRIPTION OF THE DRAWINGS

FIG. 6(*b*) is a diagram showing main parts of the panel of the hardware synthesizer connected to the PC.

DESCRIPTION OF THE EMBODIMENTS

Figure 1:
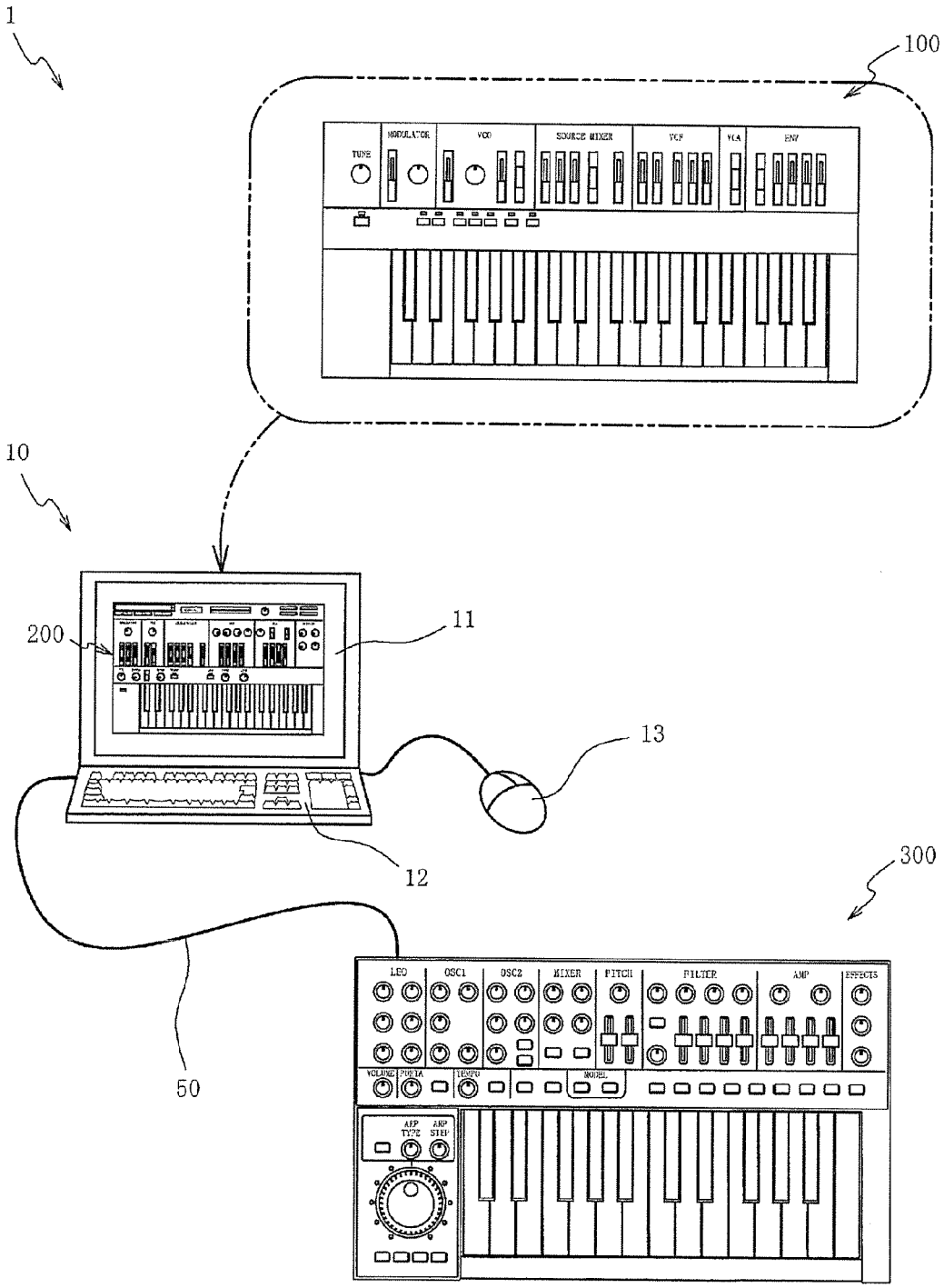
FIG. 1 is an exterior diagram showing a schematic configuration of the electronic musical instrument system.

Hereinafter exemplary embodiments of the invention are described in detail with reference to the affixed figures. FIG. 1 is an exterior diagram showing a schematic configuration of an electronic musical instrument system 1. The electronic musical instrument system 1 mainly includes a PC 10 and a digital hardware synthesizer 300, and particularly is capable of reproducing the same function and tone as an analog synthesizer 100 that is to be emulated in the PC 10 and the hardware synthesizer 300.

A first software synthesizer 20 (see FIG. 2) is stored in the PC 10, and the PC 10 is configured such that an operation of emulating the analog synthesizer 100 may be performed by the first software synthesizer 20. The PC 10 is provided with an LCD 11, a keyboard 12, and a mouse 13.

Moreover, the operation of emulating the analog synthesizer 100 is to configure the first software synthesizer 20 to operate the PC 10 to make a musical sound processing algorithm including an electronic circuit configuration or the control reaction mode and output method similar to those of the analog synthesizer 100.

An image 200 that emulates the analog synthesizer 100 by GUI is displayed on the LCD 11. Predetermined input information (e.g. the type and level of the setting parameter) is inputted from the keyboard 12 or the mouse 13 via the image 200. The first software synthesizer 20 (see FIG. 2) is capable of enabling the PC 10 to perform the operation of emulating the analog synthesizer 100 based on the input information that has been inputted.

Figure 2:
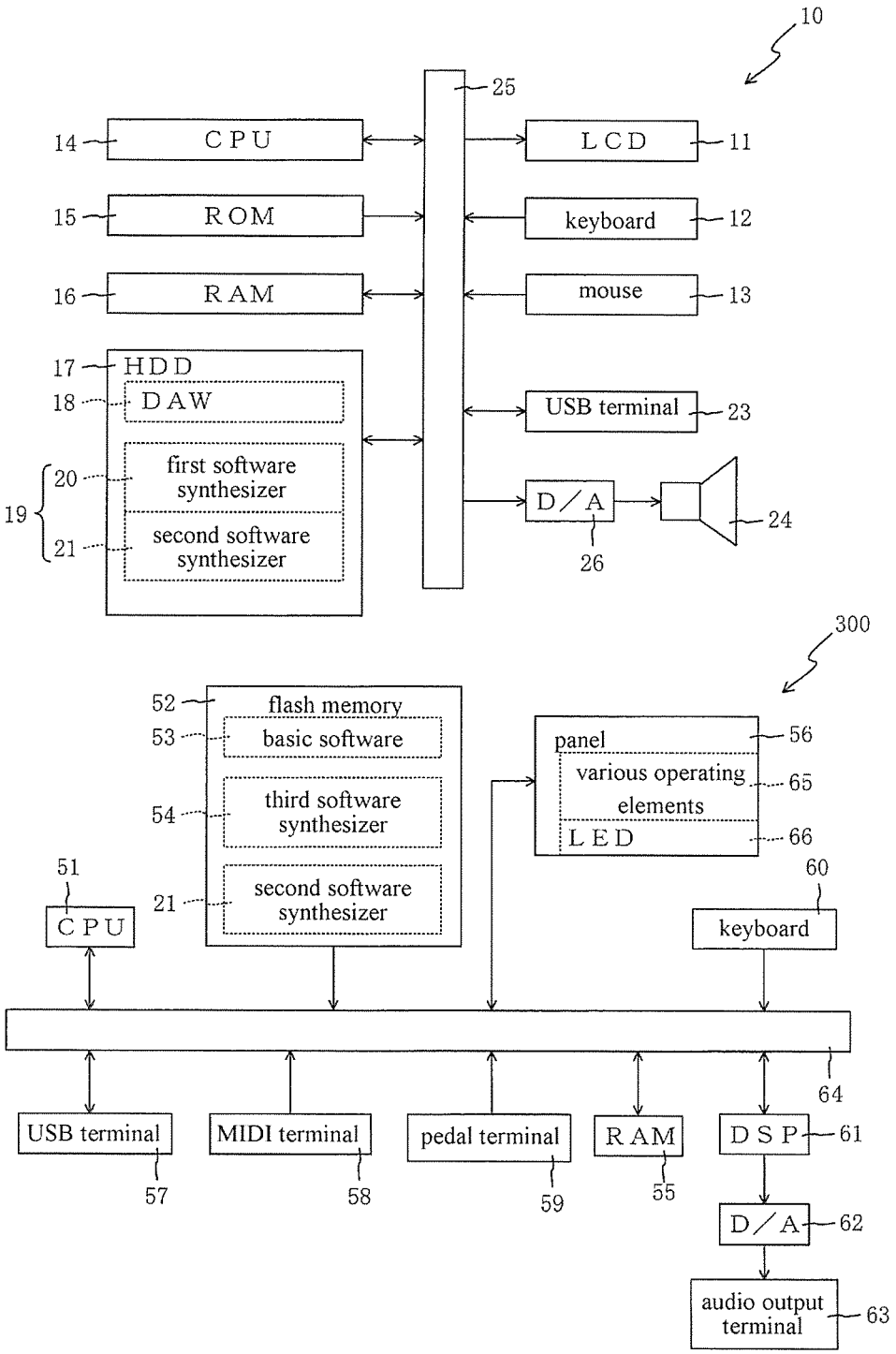
FIG. 2 is a block diagram showing an electrical configuration of the electronic musical instrument system.

Further, a second software synthesizer 21 (see FIG. 2) for enabling the hardware synthesizer 300 to perform the operation of emulating the analog synthesizer 100 is stored in the PC 10 to pair the first software synthesizer 20 (see FIG. 2).

Moreover, the operation of emulating the analog synthesizer 100 is to configure the second software synthesizer 21 and operate the hardware synthesizer 300 to make a musical sound processing algorithm including an electronic circuit configuration or the control reaction mode and output method similar to those of the analog synthesizer 100.

If the PC 10 is connected to communicate with the hardware synthesizer 300 via a USB cable 50, the second software synthesizer 21 (see FIG. 2) is installed in the hardware synthesizer 300 on condition that the hardware synthesizer 300 is confirmed to be a device corresponding to the second software synthesizer 21.

The hardware synthesizer 300 is an electronic musical instrument for synthesizing musical sounds, in which basic software 53 (see FIG. 2) and a third software synthesizer 54 (see FIG. 2) are stored.

With the basic software 53 (see FIG. 2) and the third software synthesizer 54 (see FIG. 2), the hardware synthesizer 300 is capable of generating the different musical sounds of both the synthesizer 100 to be emulated and the existing synthesizer.

In addition, if the second software synthesizer 21 (see FIG. 2) is installed from the PC 10, as described above, the hardware synthesizer 300 is capable of performing the operation of emulating the analog synthesizer 100 that is to be emulated by using the second software synthesizer 21.

Then, the first software synthesizer 20 and the second software synthesizer 21 are configured (built) such that the operation of emulating the synthesizer 100 to be emulated performed by the PC 10 and the operation of emulating the synthesizer 100 to be emulated performed by the hardware synthesizer 300 are substantially equivalent to each other. That is, the first software synthesizer 20 and the second software synthesizer 21 are respectively configured to have the same function and capable of generating the same tone with respect to the operation of emulating the analog synthesizer 100, and therefore, the PC 10 and the hardware synthesizer 300 can respectively reproduce the same function and tone as the synthesizer 100 that is to be emulated.

FIG. 2 is a block diagram showing an electrical configuration of the electronic musical instrument system 1. The PC 10 is mainly provided with a digital-to-analog converter 26 (D/A 26) that is connected to a CPU 14, a ROM 15, a RAM 16, a HDD 17, a LCD 11, the keyboard 12, the mouse 13, a USB terminal 23, and a speaker 24. These are connected via a bus 25.

The CPU 14 is a central control unit for controlling each part of the PC 10 according to fixed values or programs stored in the ROM 15 and HDD 17 and data stored in the RAM 16. The ROM 15 is a read-only memory for storing a control program to be executed by the CPU 14 or various tables as reference for executing the control program. The RAM 16 is a random access memory that is used by a working area of the CPU 14.

The hard disk drive 17 (hereinafter, HDD17) is a rewritable non-volatile memory device that retains the stored information after power-off. The HDD 17 stores a digital audio workstation (hereinafter, DAW 18) and a software synthesizer 19 obtained by grouping the first software synthesizer 20 and the second software synthesizer 21. PATCH (musical sound information and tone parameter) produced using the first software synthesizer 20 is also stored in the HDD 17.

The DAW 18 is software configured for performing a series of operations, such as recording, editing, and mixing voices, digitally. In addition, the HDD 17 stores an operating system (OS), which is read into the RAM when the PC 10 is started. The DAW 18 is application software that is managed by the OS. The first software synthesizer 20 coordinates with the DAW 18 to enable the CPU 14 (PC 10) to perform the operation of emulating the analog synthesizer 100 (see FIG. 1). The second software synthesizer 21 is installed in the hardware synthesizer 300 and enables a CPU 51 and/or a DSP 61 (hardware synthesizer 300) to perform the operation of emulating the synthesizer 100 that is to be emulated (see FIG. 1). The second software synthesizer 21 is stored in the HDD 17 as a part of the software synthesizer 19 grouped with the first software synthesizer 20. If the second software synthesizer 21 is to be installed in the hardware synthesizer 300, the second software synthesizer 21 is extracted from the software synthesizer 19 (the second software synthesizer 21 is separated from the first software synthesizer 20) and installed in the hardware synthesizer 300.

As described above, the first software synthesizer 20 and the second software synthesizer 21 are configured (built in) such that the operation of emulating the synthesizer 100 performed by the PC 10 and the operation of emulating the synthesizer 100 performed by the hardware synthesizer 300 are substantially equivalent to each other. In other words, the second software synthesizer 21 is configured considering the coordination with the first software synthesizer 20, so as to achieve a proper operation when implemented in hardware, e.g. the hardware synthesizer 300, corresponding to the second software synthesizer 21.

Thus, in this embodiment, the first software synthesizer 20 and the second software synthesizer 21 are stored as one group software synthesizer 19, and when the second software synthesizer 21 is to be installed in the hardware connected to the PC 10 via the USB terminal 23 of the PC 10, whether the hardware corresponds to the second software synthesizer 21 is confirmed. Thereby, the hardware installed with the second software synthesizer 21 and the PC 10 may be coordinated and operated properly.

The hardware synthesizer 300 is hardware that corresponds to the second software synthesizer 21. The hardware synthesizer 300 is mainly provided with the CPU 51, a flash memory 52, a RAM 55, a panel 56, a USB terminal 57, a MIDI terminal 58, a pedal terminal 59, a keyboard 60, and the DSP (digital signal processor) 61, which are connected via a bus 64. Moreover, an audio output terminal 63 is connected to the DSP 61 via a digital-to-analog converter 62 (hereinafter, D/A 62).

The CPU 51 is a central control unit that controls each part of the hardware synthesizer 300 according to fixed values or programs stored in the flash memory 52 and data stored in the RAM 53.

The flash memory 52 is a rewritable non-volatile memory, in which the basic software 53, the third software synthesizer 54, and the second software synthesizer 21 are stored. In addition, as described above, the second software synthesizer 21 is stored when installed from the PC 10. PATCH (musical sound information and tone parameter) produced using the basic software 53, the third software synthesizer 54, and the second software synthesizer 21 is also stored in the flash memory 52.

The basic software 53 is software responsible for performing basic operations of the hardware synthesizer 300, such as detecting the state of various operating elements 65 provided on the panel 56, communicating with the PC 10, turning on/off the LEDs 66, and determining to execute the third software synthesizer 54 or the second software synthesizer 21.

The third software synthesizer 54 and the second software synthesizer 21 are software executed under management of the basic software 53. The third software synthesizer 54 enables the CPU 51 to perform the original operations of the hardware synthesizer 300, and the second software synthesizer 21 enables the CPU 51 to perform the operation of emulating the synthesizer 100 that is to be emulated (see FIG. 1).

The RAM 55 is a random access memory that is used by a working area of the CPU 51. The RAM 55 is read and written by the CPU 51 as well as the DSP 61.

The panel 56 is provided with various operating elements 65 for operating the hardware synthesizer 300, and the LEDs 66 lighting the periphery of the various operating elements 65. The states of the various operating elements 65 are detected by the CPU 51, and control is performed by the CPU 51 according to the detection result. Then, the LEDs 66 are turned on/off under the control of the CPU 51.

The USB terminal 57 is an interface for connecting the PC 10 via the USB cable 50 (see FIG. 1). A variety of information outputted from the PC 10 is inputted via the USB terminal 57 and processed based on control of the CPU 51.

The MIDI terminal 58 is an interface for connecting an external MIDI machine (not shown). MIDI data outputted from the external MIDI machine is inputted via the MIDI terminal 58 and processed based on control of the CPU 51.

The pedal terminal 59 is provided with a hold terminal and a control terminal. With a pedal switch connected to the hold terminal, the sound generated may be continued while the pedal is stepped even if the hand is off the keyboard 60. If an expression pedal is connected to the control terminal, the pedal may be used to change the volume.

The keyboard 60 is composed of a plurality of white keys and black keys. When the keyboard 60 is operated by the player, sound generation control information composed of note-on information that includes pitch information and volume information or note-off information that indicates key release is processed based on control of the CPU 51.

The DSP 61 is a microprocessor that performs arithmetic processing related to a digital audio signal in coordination with the CPU 51. The software for this purpose is included in advance in the second software synthesizer 21 or the third software synthesizer 54. The D/A 62 is for converting the digital audio signal outputted from the DSP 61 into an analog audio signal. The musical sound of the analog signal converted by the D/A 62 is outputted through an external audio device connected to the audio output terminal 63. The digital audio signal outputted from the DSP 61 is also sent to the PC 10 via the USB terminal 57.

Figure 3:
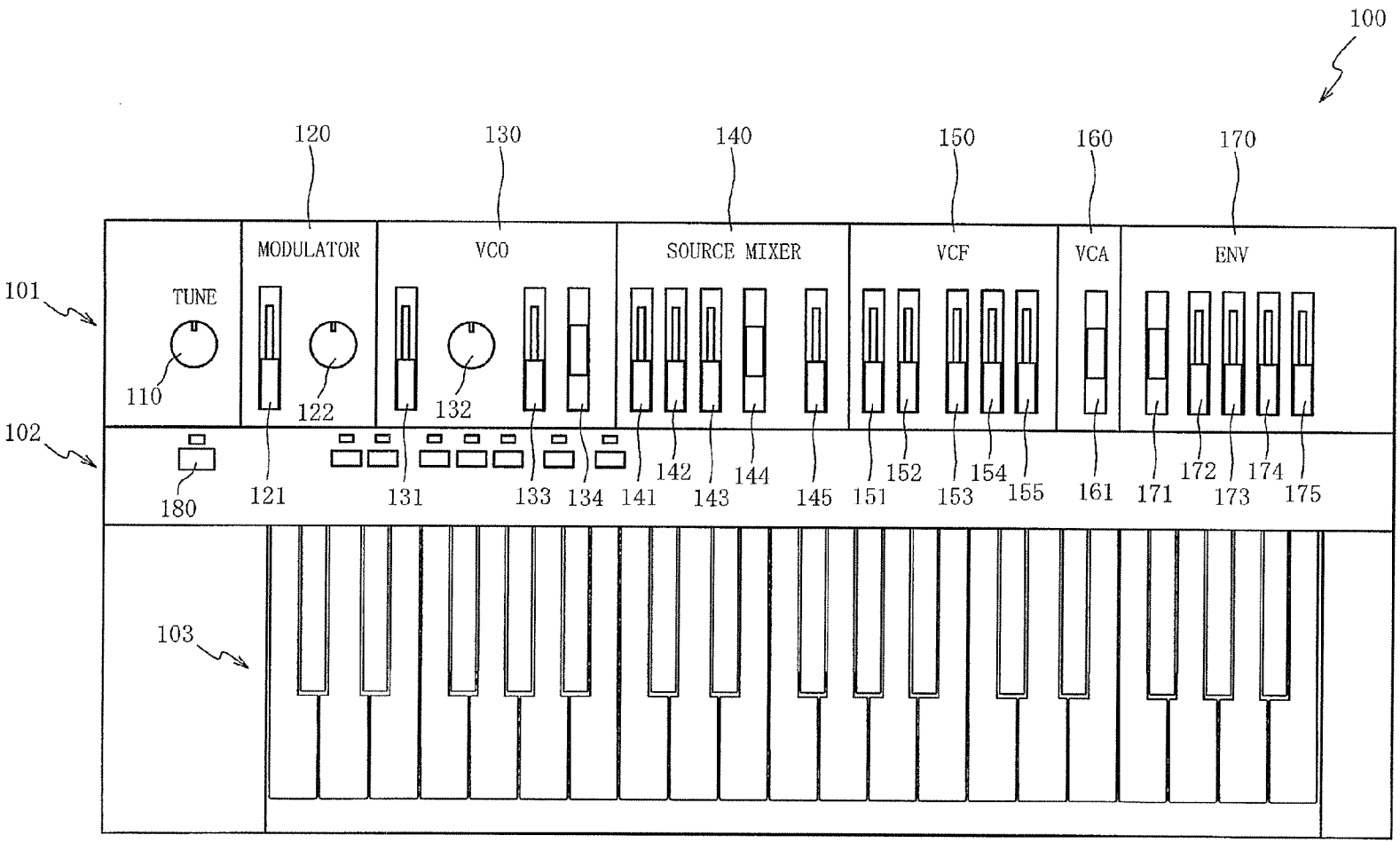
FIG. 3 is a diagram showing a panel of an analog synthesizer that is to be emulated.

FIG. 3 is a diagram showing the panel of the analog synthesizer 100 that is to be emulated. The panel of the synthesizer 100 to be emulated includes an upper region 101, a middle region 102, and a key region 103 from above. In the upper region 101, a TUNE knob 110, a MODULATOR region 120, a VCO region 130, a SOURCE MIXER region 140, a VCF region 150, a VCA region 160, and an ENV region 170 are disposed from the left side of the figure.

The TUNE knob 110 is for adjusting the overall pitch. A RATE slider 121 and a WAVE FORM knob 122 are disposed in the MODULATOR region 120. The RATE slider 121 is for setting the frequency of MODULATOR. The WAVE FORM knob 122 is for setting the waveforms of a triangular wave, a rectangular wave, a random wave, and a noise.

The VCO region 130 includes operating elements for determining the character of the sound, and a VCO MOD slider 131, a FEET knob 132, a PULSE WIDTH slider 133, and a MODE setting switch 134 are disposed therein. The VCO MOD slider 131 is for adjusting the degree of modulation of VCO by MODULATOR. The FEET knob 132 is for setting the octave of the oscillator. The PULSE WIDTH slider 133 is for adjusting the depth of change when the MODE set by the MODE setting switch 134 is ENV and LFO, and for adjusting the pulse width in the case of MAN. The MODE setting switch 134 is a switch for setting the origin for changing the pulse width of the rectangular wave, and performs setting based on three patterns, i.e. ENV (VCA envelope), LFO (modulator), and MAN (no change).

The SOURCE MIXER region 140 includes operating elements for adjusting the volumes of VCO, SUB OSC, and NOISE, wherein a rectangular wave slider 141, a sawtooth wave slider 142, a SUB OSC slider 143, an OSC TYPE setting switch 144, and a NOISE slider 145 are disposed.

The rectangular wave slider 141 is for adjusting the volume of the rectangular wave while the sawtooth wave slider 142 is for adjusting the volume of the sawtooth wave. The SUB OSC slider 143 is for adjusting the volume of SUB OSC of the type set by the OSC TYPE setting switch 144. The OSC TYPE setting switch 144 sets the type of SUB OSC from one of one octave lower, two octaves lower, and two octaves lower (small pulse width). The NOISE slider 145 is for adjusting the volume of NOISE.

The VCF region 150 includes operating elements for determining the brightness of the sound and changing the brightness, wherein a FREQ slider 151, a RES slider 152, an ENV slider 153, a VCF MOD slider 154, and a KYBD slider 155 are disposed. The FREQ slider 151 determines the cutoff frequency of the low pass filter. The RES slider 152 is for emphasizing the vicinity of the cutoff frequency of the filter. The ENV slider 153 is for determining the direction and amount that the envelope set by the ENV region 170 changes the cutoff frequency. The VCF MOD slider 154 is for adjusting the amount of change in the cutoff frequency of the VCF by MODULATOR. The KYBD slider 155 is for changing the cutoff frequency of the filter by the pitch of the key that is played.

The VCA region 160 includes an operating element for creating a temporal change in volume (envelope), wherein a VCA MODE setting switch 161 is disposed. The VCA MODE setting switch 161 is for setting the MODE of one of ENV (the sound is generated according to the envelope set by ADSR) and GATE (the sound is generated at a constant volume only when the key is pressed).

The ENV region 170 includes operating elements for creating an envelope, wherein an ENV TRIG setting switch 171 and four sliders 172-175 corresponding to A (attack time), D (decay time), S (sustain level), and R (release time) are disposed. The ENV TRIG setting switch 171 is used to set a trigger of rise of the envelope and sets one of GATE+TRIG (the envelope rises every time the key is pressed), LFO (the envelope rises repeatedly in every cycle of the modulator if the key is pressed and held), and GATE (the envelope rises when the key is repressed anew). The four sliders 172-175 are respectively for setting the A (attack time), D (decay time), S (sustain level), and R (release time).

Figure 4:
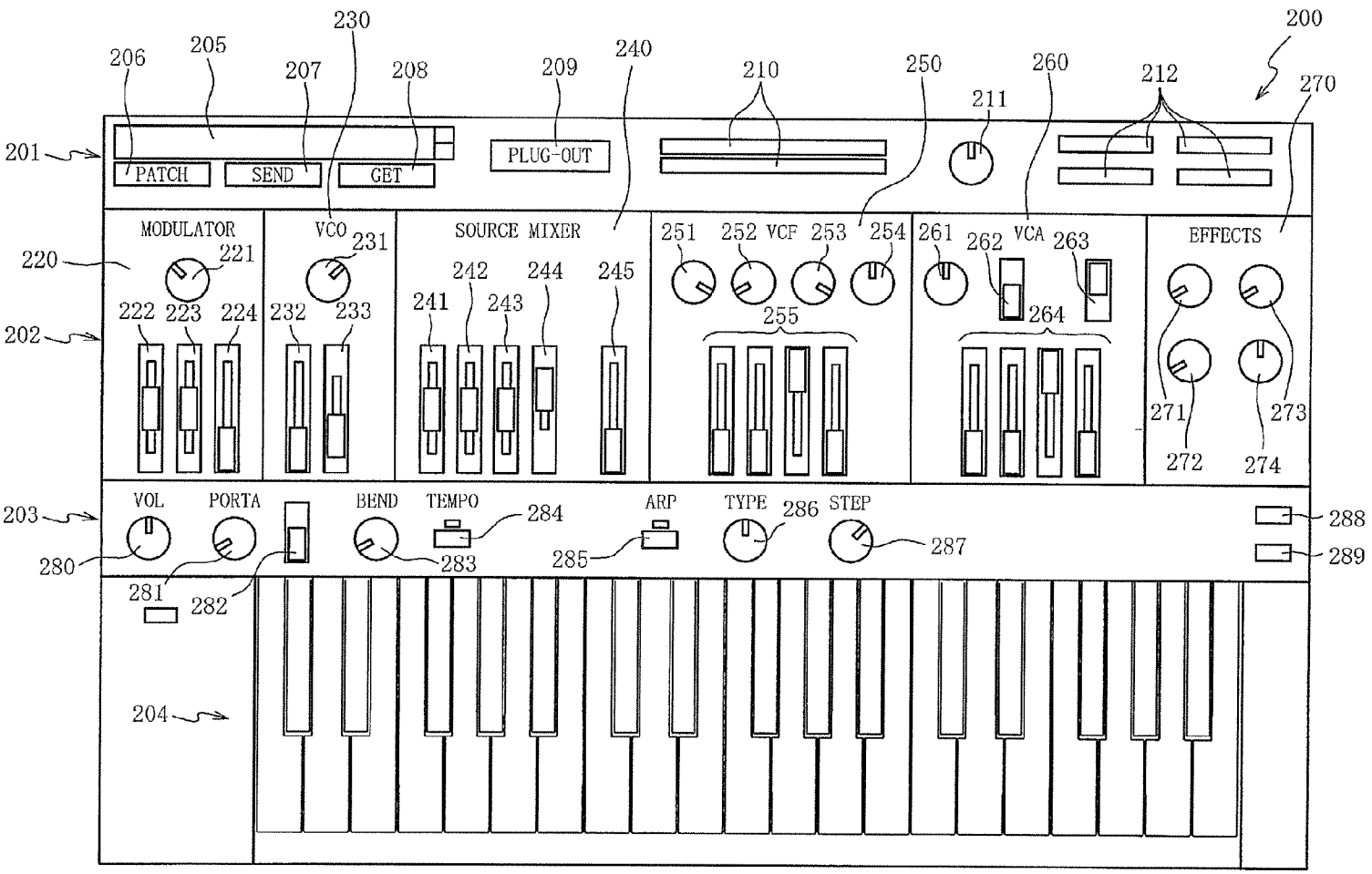
FIG. 4 is a diagram showing a panel of a first type synthesizer displayed on the PC screen.

FIG. 4 is a diagram showing the panel of a first type synthesizer 200 displayed on the screen of the PC 10. The first type synthesizer 200 of FIG. 4 is displayed on the LCD 11 of the PC 10 by the GUI of the first software synthesizer 20 incorporated into the PC 10. The operator may input the predetermined input information, such as tone parameter, by using the keyboard 12 and the mouse 13 to operate various operating elements provided on the first type synthesizer 200. In other words, the tone parameter inputted into the PC 10 by such an operation or the value related to the tone parameter corresponds to the input information inputted by a first input means of the claims.

The first type synthesizer 200 displayed on the screen of the PC 10 is an image that imitates the synthesizer 100 to be emulated. The first type synthesizer 200 includes an upper region 201, a middle region 202, a lower region 203, and a key region 204 from above.

In the upper region 201, a PATCH name display column 205, a PATCH selection button 206, a SEND button 207, a GET button 208, a PLUG-OUT button 209, a level meter 210, a TUNE knob 211, and other various buttons 212 are disposed from the left side of the figure.

The PATCH name display column 205 displays the name of the PATCH that is selected. The PATCH button 206 is a button for selecting a predetermined PATCH from the PATCH stored in the memory. When the PATCH button 206 is pressed, a list of the PATCH stored in the memory is displayed, from which the desired PATCH is selected. The PATCH may be stored in the HDD 17 or be called from the HDD 17 to be stored in the memory.

The SEND button 207 is a button for sending the PATCH stored in the memory to the hardware synthesizer 300. By pressing the SEND button 207, the PATCH stored in the PC 10 may be transmitted to the hardware synthesizer 300. In addition, the transmitted PATCH is stored in the flash memory 52 or the RAM 55 of the hardware synthesizer 300.

The GET button 208 is for importing the PATCH to the PC 10 when the PATCH stored in the flash memory 52 or the RAM 55 of the hardware synthesizer 300 is edited. By pressing the GET button 208, the PATCH stored in the flash memory 52 or the RAM 55 of the hardware synthesizer 300 may be imported to the PC 10.

The PLUG-OUT button 209 is a button for expressly incorporating the second software synthesizer 21 into the hardware synthesizer 300. As described later, in this embodiment, when the PC 10 and the hardware synthesizer 300 are connected via the USB cable 50, the second software synthesizer 21 is installed automatically into the hardware synthesizer 300. Therefore, when the PLUG-OUT button 209 is pressed, a comment corresponding to the situation of the moment is displayed. For example, a comment indicating that the installation is in progress is displayed during the installation; a comment prompting connection of the hardware synthesizer 300 is displayed if the hardware synthesizer 300 is not connected; and a comment indicating that the installation is completed is displayed if the installation has already been done. Moreover, if it is found that the second software synthesizer 21 is not installed to the hardware synthesizer 300 or does not work normally for some reason, the installation may be performed forcibly (restarted).

The level meter 210 is a column that displays the output level. The TUNE knob 211 is for adjusting the overall pitch. The other various buttons 212 are, for example, for displaying help information.

In the middle region 202, a MODULATOR region 220, a VCO region 230, a SOURCE MIXER region 240, a VCF region 250, a VCA region 260, and an EFFECTS region 270 are disposed from the left side of the figure.

The MODULATOR region 220 includes operating elements for giving the sound a periodical change, wherein a WAVE FORM knob 221, a VCO slider 222, a VCF slider 223, and a RATE slider 224 are disposed. The WAVE FORM knob 221 is for setting the waveform to any one of a sine wave, a triangular wave, a sawtooth wave, a rectangular wave, a random wave, and a noise. The VCO slider 222 is for setting the modulation amount of the pitch of the sound. The VCF slider 223 is for setting the modulation amount of the cutoff frequency of VCF. The RATE slider 224 is for setting the frequency of MODULATOR.

In the VCO region 230, operating elements for determining the character of the sound are displayed, and a FEET knob 231, a PULSE WIDTH slider 232, and a MOD setting switch 233 are disposed. The FEET knob 231 is for setting the octave of the oscillator. The PULSE WIDTH slider 232 is for adjusting the depth of the change when the setting of the MOD setting switch 233 is A.ENV, F.ENV, and LFO, and for adjusting the pulse width in the case of MAN. The MOD setting switch 233 is a switch for setting the origin for changing the pulse width of the rectangular wave, and performs setting based on four patterns, i.e. A.ENV (VCA envelope), F.ENV (VCF envelope), LFO (modulator), and MAN (no change).

The SOURCE MIXER region 240 includes operating elements for adjusting the volumes of VCO, SUB OSC, and NOISE, wherein a rectangular wave slider 241, a sawtooth wave slider 242, a SUB OSC slider 243, an OSC TYPE setting switch 244, and a NOISE slider 245 are disposed. The rectangular wave slider 241 is for adjusting the volume of the rectangular wave while the sawtooth wave slider 242 is for adjusting the volume of the sawtooth wave. The SUB OSC slider 243 is for adjusting the volume of SUB OSC of the type set by the OSC TYPE setting switch 244. The OSC TYPE setting switch 244 sets the type of SUB OSC based on three types, which are one octave lower, two octaves lower, and two octaves lower (small pulse width). The NOISE slider 245 is a slider for adjusting the volume of NOISE.

The VCF region 250 includes operating elements for determining the brightness of the sound and changing the brightness, wherein a FREQ knob 251, a RES knob 252, an ENV knob 253, a KEYBD knob 254, and four sliders 255 corresponding to A (attack time), D (decay time), S (sustain level), and R (release time) are disposed. The FREQ knob 251 determines the cutoff frequency of the low pass filter. The RES knob 252 is for emphasizing the vicinity of the cutoff frequency of the filter. The ENV knob 253 is for determining the direction and amount of change of the envelope, which causes the cutoff to change. The KEYBD knob 254 is for changing the cutoff frequency of the filter by the pitch of the key that is played. The four sliders 255 corresponding to ADSR are respectively for setting the A (attack time), D (decay time), S (sustain level), and R (release time).

The VCA region 260 includes operating elements for creating a temporal change in volume (envelope), wherein a TONE knob 261, an ENV TRIG setting switch 262, a VCA MODE setting switch 263, and four sliders 264 corresponding to A (attack time), D (decay time), S (sustain level), and R (release time) are disposed.

The TONE knob 261 is for setting the brightness of the sound. The ENV TRIG setting switch 262 is used to set a trigger of rise of the envelope based on three patterns, which are GATE+TRIG (the envelope rises every time the key is pressed), LFO (the envelope rises repeatedly in every cycle of the modulator if the key is pressed and held), and GATE (the envelope rises when the key is repressed anew). The VCA MODE setting switch 263 is for setting the pattern of sound generation based on two patterns, which are ENV (the sound is generated according to the envelope set by ADSR) and GATE (the sound is generated at a constant volume only when the key is pressed). The four sliders 255 corresponding to ADSR are respectively for setting the envelope.

The EFFECTS region 270 includes operating elements for adjusting effects, wherein a CRUSHER knob 271, a DELAY knob 272, a REVERB knob 273, and a TIME knob 274 are disposed. The CRUSHER knob 271 is for distorting the waveform to change the tone. The DELAY knob 272 is for adjusting the amount of the delay effect. The REVERB knob 273 is for adjusting the depth of the reverb. The TIME knob 274 is for adjusting the delay time.

In the lower region 203, a VOLUME knob 280, a PORTAMENTO knob 281, a MODE setting switch 282, a BEND RANGE knob 83, a TEMPO SYNC button 284, an ARPEGGIO button 285, an ARP TYPE knob 286, and an ARP STEP knob 287 are disposed from the left side of the figure.

The VOLUME knob 280 is for adjusting the overall volume. The PORTAMENTO knob 281 is for adjusting the time the pitch change takes. The MODE setting switch 282 is for setting MODE based on three patterns, which are OFF (portamento is not applied), AUTO (portamento is applied only during Legato performance), and ON (portamento is applied at all times). The BEND RANGE knob 283 is for setting the pitch change amount when pitch bend information is received. The TEMPO SYNC button 284 is a button for setting ON when operating in synchronization with the tempo of the DAW 18. The ARPEGGIO button 285 is a button for setting ON when performing arpeggio. The ARP TYPE knob 286 is for setting the arpeggio pattern. The ARP STEP knob 287 is for setting the speed of arpeggio.

Here, the various operating elements of the synthesizer 100 to be emulated of FIG. 3 and the various operating elements of the first type synthesizer 200 displayed on the screen of the PC 10 shown in FIG. 4 are compared.

As shown in FIG. 3, in the upper region 101 of the synthesizer 100 to be emulated, the RATE slider 121, the WAVE FORM knob 122, the VCO slider 131, the FEET knob 132, the PULSE WIDTH slider 133, the MODE setting switch 134, the rectangular wave slider 141, the sawtooth wave slider 142, the SUB OSC slider 143, the OSC TYPE setting switch 144, the NOISE slider 145, the FREQ slider 151, the RES slider 152, the ENV slider 153, the VCF slider 154, the KYBD slider 155, the VCA MODE setting switch 161, the ENV TRIG setting switch 171, and the four sliders 172-175 corresponding to ADSR are disposed from the left of the figure.

On the first type synthesizer 200 displayed on the screen of the PC 10 as shown in FIG. 4, the RATE slider 224, the WAVE FORM knob 221, the VCO slider 222, the FEET knob 231, the PULSE WIDTH slider 232, the MODE setting switch 233, the rectangular wave slider 241, the sawtooth wave slider 242, the SUB OSC slider 243, the OSC TYPE setting switch 244, the NOISE slider 245, the FREQ knob 251, the RES knob 252, the ENV knob 253, the VCF slider 223, the KEYBD knob 254, the VCA MODE setting switch 263, the ENV TRIG setting switch 262, and the four sliders 255 corresponding to ADSR (or the four sliders 264 corresponding to ADSR) are disposed respectively corresponding to the operating elements of the synthesizer 100 to be emulated.

In other words, when the DAW 18 and the first software synthesizer 20 are used to enable the PC 10 to emulate the synthesizer 100 to be emulated, at least a portion of the operating elements on the panel of the first type synthesizer 200 displayed on the screen of the PC 10 and the operating elements of the synthesizer 100 to be emulated have different forms or different operation methods. However, since the panel of the first type synthesizer 200 displayed on the screen of the PC 10 is provided with operating elements corresponding to the operating elements of the synthesizer 100 to be emulated, the DAW 18 and the first software synthesizer 20 may be used to enable the PC 10 to emulate the synthesizer 100 to be emulated based on the information inputted (set) via these operating elements.

Figure 5:
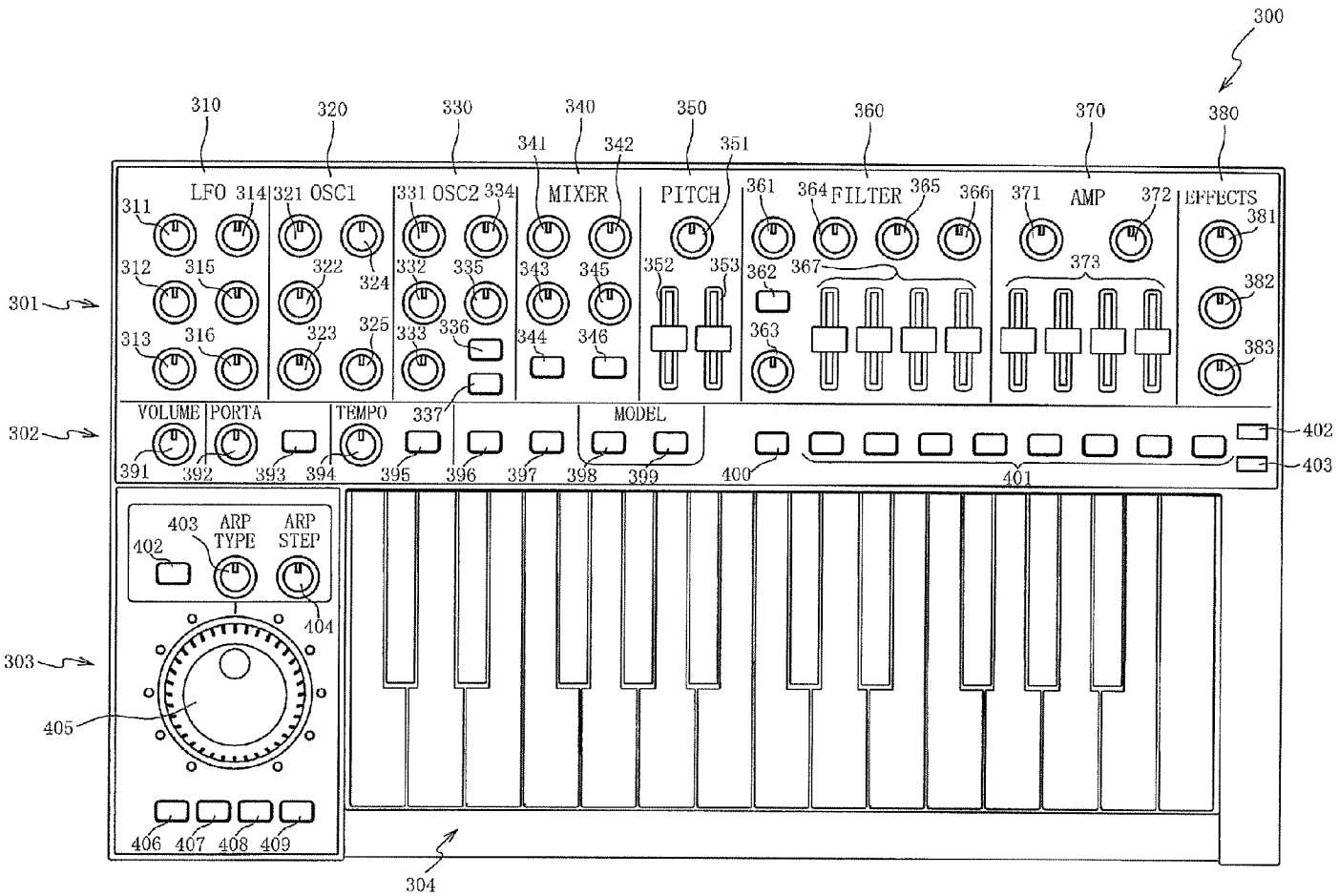
FIG. 5 is a diagram showing a panel of a hardware synthesizer connected to the PC.

FIG. 5 is a diagram showing the panel of the hardware synthesizer 300. Various operating elements are disposed on the panel of the hardware synthesizer 300, as shown in FIG. 5, and the operator may input the predetermined input information, such as tone parameter, by directly operating the various operating elements. That is, the tone parameter inputted into the hardware synthesizer 300 by such an operation or the value related to the tone parameter corresponds to the input information inputted by a second input means of the claims.

The panel of the hardware synthesizer 300 includes an upper region 301, a middle region 302, a left lower region 303, and a key region 304 from above. In the upper region 301, a LFO region 310, an OSC1 region 320, an OSC2 region 330, a MIXER region 340, a PITCH region 350, a FILTER region 360, an AMP region 370, and an EFFECTS region 380 are disposed from the left side of the figure.

The LFO region 310 includes operating elements for giving the sound a periodical change, wherein a waveform knob 311, a FADE TIME knob 312, a RATE knob 313, a PITCH knob 314, a FILTER knob 315, and an AMP knob 316 are disposed. The waveform knob 311 is for setting a sine wave, a triangular wave, a sawtooth wave, a rectangular wave, sample AND hold, and a random wave. The FADE TIME knob 312 is for setting the time from generation of the sound to the maximum amplitude of the LFO. The RATE knob 313 is for setting the frequency of MODULATOR of the LFO. The PITCH knob 314 is for changing the pitch of the sound. The FILTER knob 315 is for changing the cutoff frequency of FILTER. The AMP knob 316 is for changing the volume of AMP.

The OSC1 region 320 and the OSC2 region 330 include operating elements for selecting the waveform that determines the character of the sound and determining the pitch of the sound, wherein two oscillators (OSC1 and OSC2) are disposed on the hardware synthesizer 300. Waveform knobs 321 and 331, COLOR knobs 322 and 332, MOD knobs 323 and 333, and octave knobs 324 and 334 are respectively disposed in the OSC1 region 320 and the OSC2 region 330.

The waveform knobs 321 and 331 are respectively for setting a sawtooth wave, a rectangular wave, a triangular wave, a sawtooth wave 2, a rectangular wave 2, and a triangular wave 2. The COLOR knobs 322 and 332 are for changing the tone corresponding to the setting of the MODE knobs 323 and 333. The MOD knobs 323 and 333 are for setting the origin for changing the COLOR knobs 322 and 332. In this embodiment, the setting is performed based on six patterns, which are MAN (the tones of the locations of the COLOR knobs 322 and 332 with no time change), LFO (time changes in a cycle set by the LFO region 310), P.ENV (time changes by the envelope of the PITCH region 350), F.ENV (time changes by the envelope of the FILTER region 360), A.ENV (time changes by the envelope of the AMP region 370), and SUB OSC (time changes to meet the cycle of a sub-oscillator). In addition, a CROSS MOD knob 325 is provided in the OSC1 region 320. The CROSS MOD knob 325 is for changing the cycle of OSC1 with the waveform of OSC2. Further, a TUNE knob 335, a RING button 336, and a SYNC button 337 are disposed in the OSC2 region 330. The TUNE knob 335 is for adjusting the pitch of the oscillator. The RING button 336 is a ring modulator and the SYNC button 337 is an oscillator sync.

The MIXER region 340 includes operating elements for adjusting the volumes of OSC1, OSC2, sub-oscillator, and the noise, wherein an OSC1 knob 341, an OSC2 knob 342, a SUB OSC knob 343, an OSC TYPE setting button 344, a NOISE knob 345, a NOISE TYPE setting button 346 are disposed. The OSC1 knob 341, the OSC2 knob 342, and the SUB OSC knob 343 are for adjusting the volumes of OSC1, OSC2, and SUB OSC. The OSC TYPE setting button 344 is for setting the type of SUB OSC to one octave lower or two octaves lower. The NOISE knob 345 is for adjusting the volume of NOISE. The NOISE TYPE setting button 346 is for setting the type of NOISE to a white noise or a pink noise.

The PITCH region 350 includes operating elements for creating a temporal change of the pitch (envelope), wherein an ENV knob 351, an A slider 352, and a D slider 353 are disposed. Regarding the ENV knob 351, when the knob is turned to the right, the pitch becomes higher temporarily and then returns to the pitch of the key that is pressed; and when the knob is turned to the left, the pitch becomes lower temporarily and then returns to the pitch of the key that is pressed. The A slider 352 and the D slider 353 are respectively for setting A (attack time) and D (decay time).

The FILTER region 360 includes operating elements that determine the brightness and thickness of the sound and operating elements for creating a temporal change of the filter (envelope), wherein a LPF CUTOFF knob 361, a LPF TYPE setting button 362, a HPF CUTOFF knob 363, a RESO knob 364, an ENV knob 365, a KEY knob 366, and four sliders 367 corresponding to A (attack time), D (decay time), S (sustain level), and R (release time) are disposed. The LPF CUTOFF knob 361 is for setting the cutoff frequency of the low pass filter. The LPF TYPE setting button 362 is for setting the slope of the low pass filter to −12 dB or −24 dB. The HPF CUTOFF knob 363 determines the cutoff frequency of the high pass filter. The RESO knob 364 is for emphasizing the vicinity of the cutoff frequency of the filter. The ENV knob 365 determines the direction and amount of change of ADSR of the cutoff frequency. The KEY knob 366 is for changing the cutoff frequency of the filter by the pitch of the key that is played. The four sliders 367 corresponding to ADSR are respectively for setting the envelope.

The AMP region 370 includes operating elements for creating a temporal change of the volume (envelope), wherein a TONE knob 371, a CRUSHER knob 372, and four sliders 373 corresponding to A (attack time), D (decay time), S (sustain level), and R (release time) are disposed. The TONE knob 371 is for setting the brightness of the sound. The CRUSHER knob 372 is for distorting the waveform to change the tone. The four sliders 373 corresponding to ADSR are respectively for setting the envelope.

The EFFECTS region 380 includes operating elements for adjusting effects, wherein a REVERB knob 381, a DELAY knob 382, and a TIME knob 383 are disposed. The REVERB knob 381 is for adjusting the depth of the reverb. The DELAY knob 382 is for adjusting the delay volume. The TIME knob 383 is for adjusting the delay time.

In the middle region 302, a VOLUME knob 391, a PORTAMENTO knob 392, a LEGATO button 393, a TEMPO knob 394, a TEMPO SYNC button 395, a LFO KEY TRIG button 396, a MONO button 397, a real machine mode button 398, a plug-out button 399, a MANUAL button 400, and eight memory buttons 401 are disposed from the left side of the figure.

The VOLUME knob 391 is for adjusting the volume. The PORTAMENTO knob 392 is for continuously changing the pitch between the key that is initially played and the key that is played next and adjusting the time the pitch change takes. The LEGATO button 393 is a button for setting the mode that applies PORTAMENTO only during Legato performance. The TEMPO knob 394 is for setting the tempo of arpeggio. The TEMPO SYNC button 395 is for synchronizing the frequency of MODULATOR of the LFO region 310 or the delay time of the EFFECTS region 380 with the tempo. The LFO KEY TRIG button 396 is for setting whether to match the timing the key is played and the timing the cycle of LFO starts or not. The MONO button 397 is for setting monotone (mono) or the unison mode.

The real machine mode button 398 is for setting the mode that enables the hardware synthesizer 300 to use the basic software 53 and the third software synthesizer 54 to perform the original operation. In other words, even if the hardware synthesizer 300 has been set to the mode that uses the basic software 53 and the second software synthesizer 21 to perform the operation of emulating the synthesizer 100 to be emulated, the hardware synthesizer 300 may still be enabled to perform the original operation by pressing the real machine mode button 398.

The plug-out button 399 is for setting the mode that enables the hardware synthesizer 300 to use the basic software 53 and the second software synthesizer 21 to perform the operation of emulating the synthesizer 100 to be emulated. In other words, even if the hardware synthesizer 300 has been set to the mode of performing the original operation, the hardware synthesizer 300 may still be enabled to perform the operation of emulating the synthesizer 100 to be emulated by pressing the plug-out button 399. The MANUAL button 400 is for inputting an instruction to play a sound in the current state of the operating elements. The eight memory buttons 401 are for registering/calling the current setting of the panel and may register up to eight settings.

In the lower region 303, an ARPEGGIO button 402, an ARP TYPE knob 403, an ARP STEP knob 404, a jog shuttle 405, a KEY HOLD button 406, an OCTAVE DOWN button 407, an OCTAVE UP button 408, and a MOD button 409 are disposed. The ARPEGGIO button 402 is for setting the arpeggio performance. The ARP TYPE knob 403 is for setting the pattern of how arpeggio is played. The ARP STEP knob 404 is for setting how many notes are in one step of arpeggio. The jog shuttle 405 operates as a pitch bend. The KEY HOLD button 406 is for keeping the sound playing even when the player's hands are off the keys. The OCTAVE DOWN button 407 and the OCTAVE UP button 408 are for setting by moving the pitch of the keys with one octave as a unit. The MOD button 409 is for setting to apply vibrato (modulation) to the sound while the button is pressed.

Thus, the hardware synthesizer 300 has operating elements different from those of the synthesizer 100 to be emulated and those of the existing synthesizer, and based on the information inputted (set) via these operating elements, the hardware synthesizer 300 may use the basic software 53 and the third software synthesizer 54 to generate a unique tone that differs from the synthesizer 100 to be emulated and the existing synthesizer.

In addition, in the case where the hardware synthesizer 300 with such a configuration is enabled to perform the operation of emulating the synthesizer 100 to be emulated by using the basic software 53 and the second software synthesizer 21, each operating element of the hardware synthesizer 300 is set according to the second software synthesizer 21 as shown in the following FIG. 6.

Figure 6A:
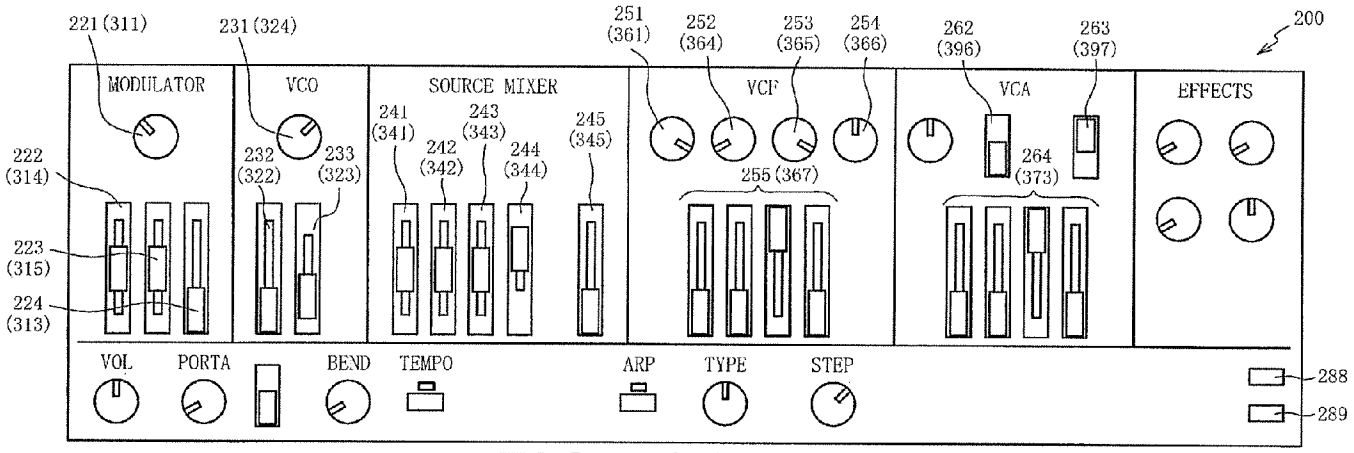
FIG. 6(*a*) is a diagram showing main parts of the panel of the first type synthesizer displayed on the PC screen.
Figure 6B:
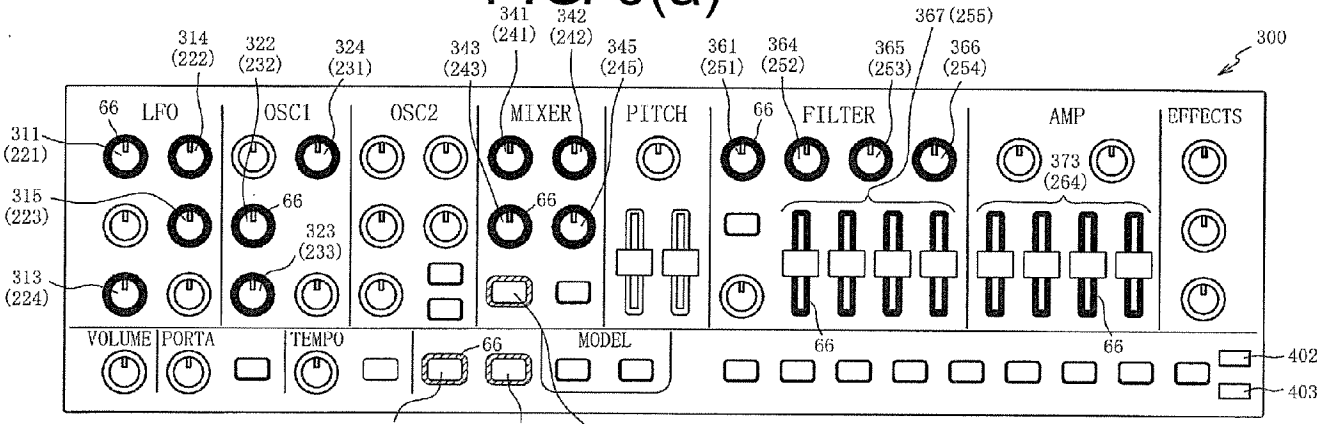

In FIG. 6(*a*), with respect to the operating elements that correspond to the operating elements of the synthesizer 100 to be emulated among the operating elements of the first type synthesizer 200 displayed on the screen of the PC 10, the operating elements of the hardware synthesizer 300 corresponding thereto are indicated in parentheses.

In FIG. 6(*b*) as opposed to FIG. 6(*a*), with respect to the operating elements that correspond to the operating elements of the synthesizer 100 to be emulated among the operating elements of the hardware synthesizer 300, the operating elements of the first type synthesizer 200 displayed on the screen of the PC 10 corresponding thereto are indicated in parentheses.

That is, each operating element of the hardware synthesizer 300, as shown in FIG. 6(*a*) and FIG. 6(*b*), is set as follows according to the second software synthesizer 21. In other words, the function corresponding to the RATE slider 224 displayed on the screen of the PC 10 is set to the RATE knob 313 of the hardware synthesizer 300 (which is indicated as RATE slider 224 (RATE knob 313)). Likewise, WAVE FORM knob 221 (waveform knob 311), VCO slider 222 (PITCH knob 314), FEET knob 231 (octave knob 324), PULSE WIDTH slider 232 (COLOR knob 322), MODE setting switch 233 (MODE knob 323), rectangular wave slider 241 (OSC1 knob 341), sawtooth wave slider 242 (OSC2 knob 342), SUB OSC slider 243 (SUB OSC knob 343), OSC TYPE setting switch 244 (TYPE setting button 344), NOISE slider 245 (NOISE knob 345), FREQ knob 251 (LPF CUTOFF knob 361), RES knob 252 (RESO knob 364), ENV knob 253 (ENV knob 365), VCF slider 223 (FILTER knob 315), KEYBD knob 254 (KEY knob 366), VCA MODE setting switch 263 (MONO button 397), ENV TRIG setting switch 262 (LFO KEY TRIG button 396), four sliders 255 corresponding to ADSR (four sliders 367 corresponding to ADSR), and four sliders 264 corresponding to ADSR (four sliders 373 corresponding to ADSR) are set. As to the OSC TYPE setting switch 244, the VCA MODE setting switch 263, and the ENV TRIG setting switch 262, since the hardware synthesizer 300 does not have changeover switches of the corresponding forms, the TYPE setting button 344, the MONO button 397, and the LFO KEY TRIG button 396 may be pressed multiple times to serve as substitutes for the changeover switches. The changeover states of these buttons are indicated by turning on, flashing, or turning off of the surrounding LEDs.

Accordingly, the operating elements of the first type synthesizer 200 displayed on the screen of the PC 10 as shown in FIG. 6(*a*) and the hardware synthesizer 300 as shown in FIG. 6(*b*) are respectively set corresponding to the operating elements of the synthesizer 100 to be emulated by the first and second software synthesizers 20 and 21. Moreover, although the first and second software synthesizers 20 and 21 have different configurations with respect to the operating elements corresponding to the synthesizer 100 to be emulated, they may be set for inputting the same parameter in the same range.

For example, the "RATE slider 224" of the first type synthesizer 200 displayed on the screen of the PC 10 as shown in FIG. 6(*a*) and the "RATE knob 313" of the hardware synthesizer 300 as shown in FIG. 6(*a*) are set to serve as the operating element corresponding to the "RATE slider 121" of the synthesizer 100 to be emulated in FIG. 3.

In this case, the "RATE slider 224" shown in FIG. 6(*a*) is a slider-type operating element while the "RATE knob 313" shown in FIG. 6(*b*) is a dial-type operating element, and they have different forms and operating methods. However, the first and second software synthesizers 20 and 21 are programmed mutually, such that the parameters inputted by operating the "RATE slider 224" and the "RATE knob 313" and the input ranges are identical to each other. The same also applies to the other operating elements. Thus, the PC 10 and the hardware synthesizer 300 are capable of reproducing the same function and tone of the synthesizer 100 to be emulated.

Moreover, the second software synthesizer 21 is configured so that the information inputted via the operating elements of the first type synthesizer 200 displayed on the screen of the PC 10 and the information inputted via the operating elements of the hardware synthesizer 300 are limited by the input range of the operating elements of the hardware synthesizer 300. Generally, the PC 10 has higher processing capacity than the hardware synthesizer 300 and has much larger memory capacity.

Therefore, the first software synthesizer 20 may be built in any way according to the capacity of the PC 10. However, it is possible that the operation of emulating the synthesizer 100 to be emulated, which is executed by the hardware synthesizer 300 by the second software synthesizer 21, may not be configured equivalent to that executed by the PC 10 due to the processing capacity of the hardware synthesizer 300. Thus, by limiting the information inputted to the PC 10 to the input range that can be done via the operating elements of the hardware synthesizer 300, it is possible to prevent such a situation, i.e. the operation of emulating the synthesizer 100 to be emulated, which is executed by the hardware synthesizer 300 by the second software synthesizer 21, may not be configured equivalent to that executed by the PC 10.

On the other hand, the hardware synthesizer 300 that has the DSP 61 may be better in the arithmetic processing of the audio signal. Therefore, it is possible that the first software synthesizer 20 may not be able to execute the emulation operation which the second software synthesizer 21 is capable of. Accordingly, the configuration is made such that the software of the emulation operation is substantially equivalent in the PC 10 and the hardware synthesizer 300.

Furthermore, as shown in FIG. 6(*b*), the LED 66 is disposed around each operating element of the hardware synthesizer 300. In the case where the basic software 53 and the second software synthesizer 21 enable the hardware synthesizer 300 to perform the operation of emulating the synthesizer 100 to be emulated, the LED 66 around the operating element being used on the hardware synthesizer 300 is turned on (see the operating element surrounded by a black area). Thus, when the hardware synthesizer 300 performs the operation of emulating the synthesizer 100 to be emulated, even though there are some operating elements that are not in use, they can be clearly distinguished from the operating elements that are in use to facilitate the operator's operation.

Moreover, as shown in FIG. 6(*b*), the LEDs 66 disposed around the TYPE setting button 344, the LFO KEY TRIG button 396, and the MONO button 397 are configured to be turned on, flash, or turned off according to the functions of the buttons and do not indicate whether the buttons are usable. However, multicolor LED, for example, may also be used to distinguish the buttons that are not in use and the buttons that are in use, wherein the LED is turned off when the button is not usable; and when the button is usable, the LED is lighted with a color corresponding to the function (setting value).

Furthermore, two sets of sliders, each including four sliders (255 and 264) corresponding to ADSR, are disposed on the panel of the first type synthesizer 200 displayed on the screen of the PC 10, as shown in FIG. 6(*a*). In addition, two sets of sliders, each including four sliders (367 and 373) corresponding to ADSR, are disposed on the panel of the hardware synthesizer 300, as shown in FIG. 6(*b*).

In contrast thereto, the synthesizer 100 to be emulated only includes a set of four sliders 172-175 corresponding to ADSR, as shown in FIG. 3.

Since the four sliders 172-175 corresponding to ADSR disposed on the synthesizer 100 to be emulated have operating elements associated with ENV in the VCO region 130, the VCF region 150, and the VCA region 160, musical effects according to the setting of the four sliders 172-175 corresponding to one set of ADSR are generated for any one of the VCO, VCF, and VCA.

In contrast, in the first and second software synthesizers 20 and 21, two sets of four sliders corresponding to ADSR are provided respectively for VCF (F.ENV) and VCA (A.ENV). Therefore, for VCF, the four sliders 255 corresponding to ADSR (the four sliders 367 corresponding to ADSR) are enabled, and there is no influence on VCA (A.ENV). Conversely, the four sliders 264 corresponding to ADSR (the four sliders 373 corresponding to ADSR) are enabled for VCA, and there is no influence on VCF (F.ENV). With regard to VCO, it is possible to select and switch between VCF (F.ENV) and VCA (A.ENV) by a switch to enable either set for VCO.

In other words, with the first and second software synthesizers 20 and 21, the settings for VCF (F.ENV) and VCA (A.ENV) may be made different to produce a tone that the synthesizer 100 to be emulated cannot produce. Thus, instead of faithfully emulating the synthesizer 100 to be emulated, the function or circuit operation of the synthesizer may be expanded to a certain extent. In such a case, nevertheless, it is necessary to implement the expansion only in the range that both the first and second software synthesizers 20 and 21 can achieve substantially equivalent effects, so as to prevent a situation that the operation that can be achieved by one of the first and second software synthesizers 20 and 21 cannot be achieved by the other. (Needless to say, regarding functions not directly related to the operation of the analog synthesizer, which are in the range that exceeds emulation of the operation of the synthesizer 100 and the expansion thereof, those functions may be different on the PC 10 and the hardware synthesizer 300, for example.)

On the other hand, because the synthesizer 100 to be emulated can only be set with one set of ENV, the operator may demand the first and second software synthesizers 20 and 21 that emulate it to perform the same operation as the synthesizer 100 to be emulated. In this case, if the setting values for VCF (F.ENV) and the setting values for VCA (A.ENV) are all set to be the same, substantially, the music can be produced within the range of the same function as the synthesizer 100 to be emulated. However, it is troublesome to set all the setting values for VCF (F.ENV) and the setting values for VCA (A.ENV) to be the same.

Therefore, in this embodiment, the first type synthesizer 200 displayed on the screen of the PC 10 is provided with a disable button 208 as shown in FIG. 6(*a*), and the hardware synthesizer 300 is provided with a disable button 402 as shown in FIG. 6(*b*). The disable buttons 208 and 402 are for disabling a function that is beyond the capability of the synthesizer 100 to be emulated. Accordingly, the music can be produced in a manner the operator desires.

Figure 7:
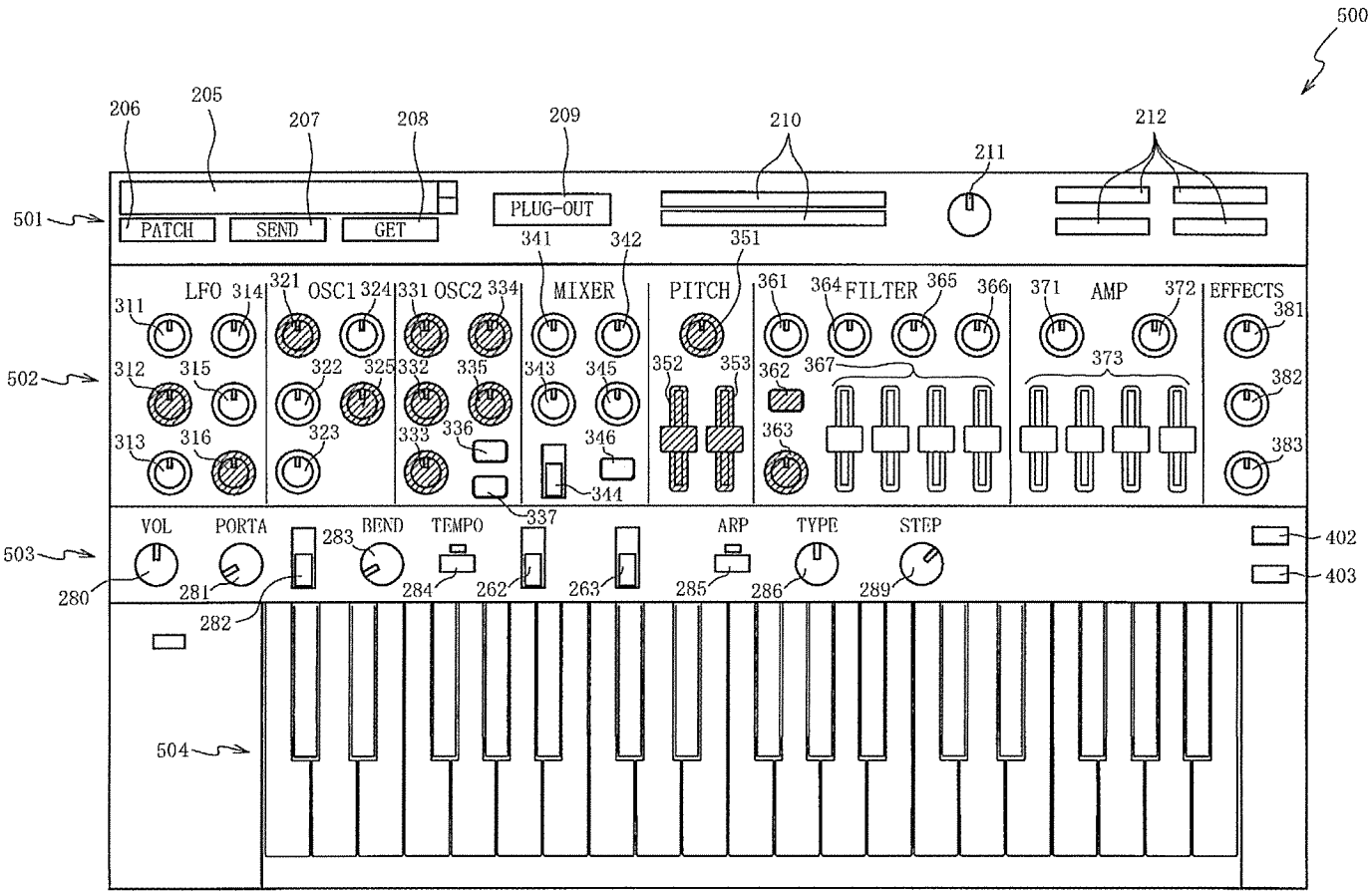
FIG. 7 is a diagram showing a panel of a second type synthesizer displayed on the PC screen.

FIG. 7 is a diagram showing the panel of the second type synthesizer 500 displayed on the screen of the PC 10. The PC 10 (the first software synthesizer 20) is capable of selectively displaying the second type synthesizer 500 of FIG. 7 on the screen of the PC 10 in addition to the first type synthesizer 200 of FIG. 4.

The first type synthesizer 200 is an image that emulates the synthesizer 100 to be emulated while the second type synthesizer 500 is an image that emulates the hardware synthesizer 300. In other words, an upper region 501, a middle region 502, a lower region 503, and a key region 504 are disposed from above in the panel diagram of the second type synthesizer.

The upper region 501 has the same configuration as the upper region 201 of the first type synthesizer 200 shown in FIG. 4. Thus, each component in the upper region 501 is assigned with the same reference numeral as that in the upper region 201 of the first type synthesizer 200 shown in FIG. 4, and a description thereof is omitted.

The middle region 502 has substantially the same configuration as the upper region 301 of the hardware synthesizer 300 shown in FIG. 5. Thus, each component in the middle region 502 is assigned with the same reference numeral as that in the upper region 301 of the hardware synthesizer 300 shown in FIG. 5, and a description thereof is omitted.

The lower region 503 has substantially the same configuration as the lower region 203 of the first type synthesizer 200 shown in FIG. 4. That is, in the first type synthesizer 200 as shown in FIG. 4, the ENV TRIG setting switch 262 and the VCA MODE setting switch 263 are disposed in the VCA region 260 of the middle region 202. However, in the second type synthesizer 500, the ENV TRIG setting switch 262 and the VCA MODE setting switch 263 are disposed in the lower region 503. This is the only difference.

In addition, in the image of the second type synthesizer 500, the operating elements that are used when the hardware synthesizer 300 is enabled to perform the operation of emulating the synthesizer 100 to be emulated by using the basic software 53 and the second software synthesizer 21 (see the operating element surrounded by a black area in FIG. 6(*b*)) are indicated to be distinguishable from operating elements that are not in use.

That is, the operating elements that are not in use (see the operating element covered with oblique lines in FIG. 7) are indicated thinner than the operating elements that are in use (see the operating element surrounded by a black area in FIG. 6(*b*)). Moreover, when the operating elements other than those covered with oblique lines in FIG. 7 (the operating elements that are in use) and the operating elements lit by the surrounding LEDs in FIG. 6 (see the operating element surrounded by a black area) are compared, it is understood that they match each other.

Since the operator may operate the PC 10 with the same feeling as operating the hardware synthesizer 300 and know the operating elements that are not in use, the operability is improved.

Figure 8:
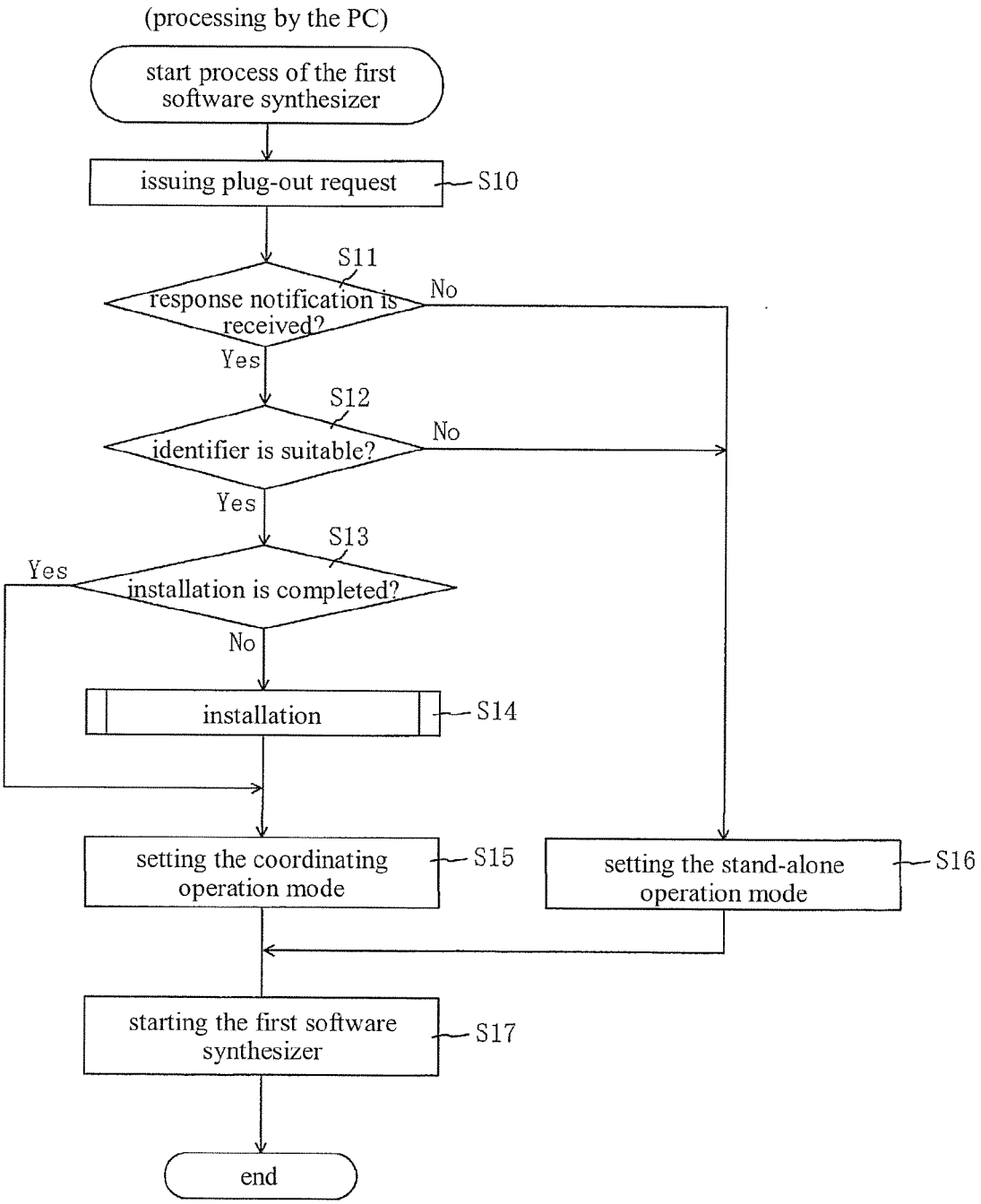
FIG. 8 is a flowchart showing a start process of the first software synthesizer.

Next, a start process of the first software synthesizer is explained with reference to the flowchart of FIG. 8. The start process of the first software synthesizer is executed when the DAW 18 is started by the PC 10 (CPU 14). The CPU 14 issues a plug-out request (S10). That is, in order to install the second software synthesizer 21, an identifier (e.g. ID indicating the predetermined model name or model type) assigned to the hardware synthesizer 300 is requested to be transferred to the hardware synthesizer 300 connected via the USB cable 50.

The CPU 14 confirms whether a response notification from the hardware synthesizer 300 is received and then determines whether the identifier included in the response notification is suitable (S12) when the response notification is received (S11: Yes). Information regarding such identifier is included as part of the software synthesizer 19 obtained by grouping the first software synthesizer 20 and the second software synthesizer 21.

According to the result of S12, if the identifier is suitable (S12: Yes), the CPU 14 determines whether the installation of the second software synthesizer 21 is completed (S13). If the installation is not completed (S13: No), the CPU 14 notifies the hardware synthesizer 300 to install the second software synthesizer 21 and starts the process of installing the second software synthesizer 21 to the hardware synthesizer 300 (S14). If the CPU 14 determines that the installation is completed in S13 (S13: Yes), the CPU 14 skips the process of S14 and moves on to the process of S15.

The CPU 14 sets a coordinating operation mode (S15) in the process of S15. The coordinating operation mode is a mode, in which the PC 10 and the hardware synthesizer 300 coordinate with each other to generate musical sounds while exchanging information with the hardware synthesizer 300.

In the case that there is no response notification from the hardware synthesizer 300 in the process of S11 (S11: No), or if the identifier is not suitable in the process of S12 (S12: No), the CPU 14 sets a stand-alone operation mode (S16). The stand-alone operation mode is a mode, in which the PC 10 generates musical sounds alone without exchanging information with the hardware synthesizer 300.

After setting the coordinating operation mode in S15 or the stand-alone operation mode in S16, the CPU 14 starts the first software synthesizer (S17) and ends the process.

By performing the start process of the first software synthesizer, the installation of the second software synthesizer 21 is executed after confirming that the destination device to which the second software synthesizer 21 is to be installed is the corresponding one. Therefore, the second software synthesizer 21 can be installed to the proper destination device. Thus, the operation of emulating the software synthesizer 100 to be emulated can be performed correctly in the destination device.

Further, in the case where the installation of the second software synthesizer 21 is completed or the second software synthesizer 21 has already been installed, the coordinating operation mode is set automatically. Therefore, it is possible to avoid the situation that the operation of emulating the software synthesizer 100 to be emulated is not performed correctly in the destination device, which results in that the operation of emulating the software synthesizer 100 to be emulated is not performed correctly in the PC 10.

Next, a start process of the second and third software synthesizers is explained with reference to the flowchart of FIG. 9. The start process of the second and third software synthesizers is executed when the power for the hardware synthesizer 300 is inputted by the hardware synthesizer 300 (CPU 51).

The CPU 51 sets the stand-alone operation mode (S20). The stand-alone operation mode is a mode, in which the hardware synthesizer 300 generates musical sounds alone without exchanging information with the PC 10.

The CPU 51 starts the basic software 53 (S21) and confirms whether a communication is received from the PC 10 (S22). If the communication is received (S22: Yes), the CPU 51 determines whether it is the plug-out request (S23). If so (S23: Yes), the CPU 51 notifies the PC 10 of a response including an identifier (S24).

Then, the CPU 51 determines whether the installation of the second software synthesizer 21 is completed (S25). If the installation is not completed (S25: No), the CPU 51 determines whether an installation instruction is received from the PC 10 (S26). If the instruction is received (S26: Yes), the second software synthesizer 21 is installed from the PC 10 (S27). If the CPU 51 determines that the installation is completed in S25 (S25: Yes), the CPU 51 notifies the PC 10 of the same and skips the process of S27 to move on to the process of S28. The CPU 51 sets the coordinating operation mode in the process of S28 (S28) and starts the second software synthesizer (S29) and then ends the process.

On the other hand, if the communication from the PC 10 is not received in the process of S22 (S22: No), the communication from the PC 10 is not the plug-out request in the process of S23 (S23: No), or the installation instruction is received from the PC 10 in the process of S26 (S26: No), the CPU 14 starts the third software synthesizer (S30) and ends the process.

Thus, by performing the start process of the second and third software synthesizers, the second software synthesizer 21 can be automatically installed and the coordinating operation mode that uses the second software synthesizer 21 can be set automatically once the user connects the PC 10 and the hardware synthesizer 300.

Next, a sound source control process is explained with reference to the flowchart of FIG. 10. The sound source control process is executed by an interrupt process that is executed periodically by the PC 10 (CPU 14) when the PC 10 is set to the coordinating operation mode. Moreover, the PC 10 is in a state capable of communicating with the hardware synthesizer 300 via the USB cable 50.

The CPU 14 determines whether it is a command from the DAW 18 (S40). If the command is from the DAW 18 (S40: Yes), the CPU 14 determines whether it is the type that transmits the information generated by the DAW 18 itself or the information obtained by the DAW 18 to the external (i.e. the hardware synthesizer 300) (S44). Consequently, if it is the type that transmits the information to the hardware synthesizer 300 (S44: Yes), the process of S42 that transmits the operation content (the event (operation) of operating the operating elements of the synthesizer 200 displayed on the screen of the PC 10 (see FIG. 4) and the operating elements of the synthesizer 500 (see FIG. 7) by the keyboard 12 and the mouse 13 to affect the sound source operation, i.e. the information inputted to the PC 10) to the hardware synthesizer 300 is skipped and the sound source is controlled (S43), and then the process ends.

That is, in the process of S42, control such as sound generation or tone change is performed based on the information from the DAW 18, and this information is not transmitted to the hardware synthesizer 300. It is because that this information also includes the information from the hardware synthesizer 300, and if this information is sent, the information loops.

Accordingly, if the command is from the DAW 18 (S40: Yes) and the DAW 18 does not transmits the information to the external (S44: Yes), the sound source is controlled without transmitting the operation content to the hardware synthesizer 300. Therefore, looping of the information caused by re-transmitting the information from the hardware synthesizer 300 to the hardware synthesizer 300 can be prevented.

On the other hand, if the DAW 18 does not transmit the information to the external in the process of S44 (S44; No), the CPU 14 determines whether the information is transmitted from the external (i.e. the hardware synthesizer 300) (S45). Whether the information is transmitted from the hardware synthesizer 300 may be identified by MIDI channel information and the identifier contained in the data. Consequently, if the information is transmitted from the hardware synthesizer 300 (S45: Yes), the CPU 14 skips the process of S42 of transmitting the operation content to the hardware synthesizer 300 and controls the sound source (S43) and then ends the process. Therefore, in this case, looping of the information caused by re-transmitting the information from the hardware synthesizer 300 to the hardware synthesizer 300 can also be prevented.

If the CPU 14 determines that the information is not transmitted from the hardware synthesizer 300 (S45: No), the CPU 14 transmits the operation content to the hardware synthesizer 300 (S42) and controls the sound source (S43) and then ends the process.

Therefore, even if the DAW 18 does not transmit the information to the external (S44; No), the information that affects the sound source operation is prevented from looping and can be shared with the hardware synthesizer 300. Whether the DAW 18 transmits the information has been determined in advance by the type of the DAW and may be discriminated by inquiring the DAW 18 through the first software synthesizer 21.

Further, if it is not the command from the DAW 18 in the process of S40 (S40: No), the CPU 14 determines whether a GUI operation has been performed (S41). That is, the first software synthesizer 21 imports the information with the operation of the keyboard 12 and the mouse 13 as the GUI (Graphical User Interface) based on the screen the first software synthesizer 21 displays.

Then, when being notified that the event (the information inputted to the PC 10 by operating the operating elements of the synthesizer 200 displayed on the screen of the PC 10 (see FIG. 4) and the operating elements of the synthesizer 500 (see FIG. 7) by the keyboard 12 and the mouse 13) which affects the sound source due to the operation of its own GUI from the first software synthesizer 21 is detected (S41: Yes), the CPU 14 transmits the information to the hardware synthesizer 300 (S42) and controls the sound source based on the information (S42) and then ends the process. In addition, if the GUI operation is not detected in the process of S41 (S41: No), the process is ended without change.

With the sound source control process, the information the first software synthesizer 21 transmits to the hardware synthesizer 300 can be discriminated according to the operation of the DAW 18 (whether the information is transmitted to the external). Therefore, information looping between the PC 10 and the hardware synthesizer 300 can be prevented and the information that affects the sound source operation can always be shared with the other side.

Next, a sound source control process is explained with reference to the flowchart of FIG. 11. When it is set to the coordinating operation mode and the mode of performing the operation of emulating the synthesizer 100 to be emulated, the sound source control process is executed by an interrupt process that is executed periodically by the hardware synthesizer 300 (CPU 51). In addition, the hardware synthesizer 300 is in a state communicable with the PC 10 via the USB terminal 57, and is connected to a large keyboard via the MIDI terminal 58 and a sustain pedal (hold pedal) via the pedal terminal 59.

The CPU 51 determines whether it is a command from the PC 10 (S50). If the command is from the PC 10 (S50: Yes), the CPU 51 skips the process of S53 that transmits the operation content (information related to an event (operation) that affects the sound source operation, such as the information inputted to the hardware synthesizer 300 by operating various operating elements of the hardware synthesizer 300, information from the MIDI terminal 58, and information from the pedal terminal 59) to the PC 10 and controls the sound source (S54), and then ends the process. Therefore, looping of the information between the hardware synthesizer 300 and the PC 10 can be prevented.

On the other hand, if the command is not from the PC 10 in the process of S50 (S50: No), the CPU 51 determines whether there is input from the MIDI terminal 58 (S51). If the input is from the MIDI terminal 58 (S51: Yes), the CPU 51 transmits the operation content to the PC 10 (S53) and controls the sound source (S54) and then ends the process.

Moreover, if the CPU 51 determines that there is no input from the MIDI terminal in the process of S51 (S51: No), the CPU 51 determines whether there is input from the pedal terminal 59 (S52). If the input is from the pedal terminal 59 (S52: Yes), the CPU 51 transmits the operation content to the PC 10 (S53) and controls the sound source (S54) and then ends the process. If the input is not from the pedal terminal in the process of S52 (S52: No), the process is ended.

Thus, in the sound source control process performed in the hardware synthesizer 300, information from the PC 10, information from the MIDI terminal 58, information from the pedal terminal 59, and the status of the operating elements on the panel body are monitored to be reflected to the sound source if there is the event that affects the sound source operation, and information except for the information from the PC 10 is transmitted to the PC 10. By doing so, for example, the result of operating the keyboard connected to the hardware synthesizer 300 can be effective to both the hardware synthesizer 300 and the PC 10.

If a sequencer is operated on the DAW 18 of the PC 10, the information is sent from the DAW 18 to both the hardware synthesizer 300 and the PC 10. Thus, they perform sound generation or tone change in the same way.

In addition, when the operating elements of the hardware synthesizer 300 or the operating elements on the screen of the PC 10 are operated, the same sound source control based on the operation is performed on both the hardware synthesizer 300 and the PC 10, and the same sound can be generated by either of the hardware synthesizer 300 and the PC 10 at any time with no distinction.

Figure 10:
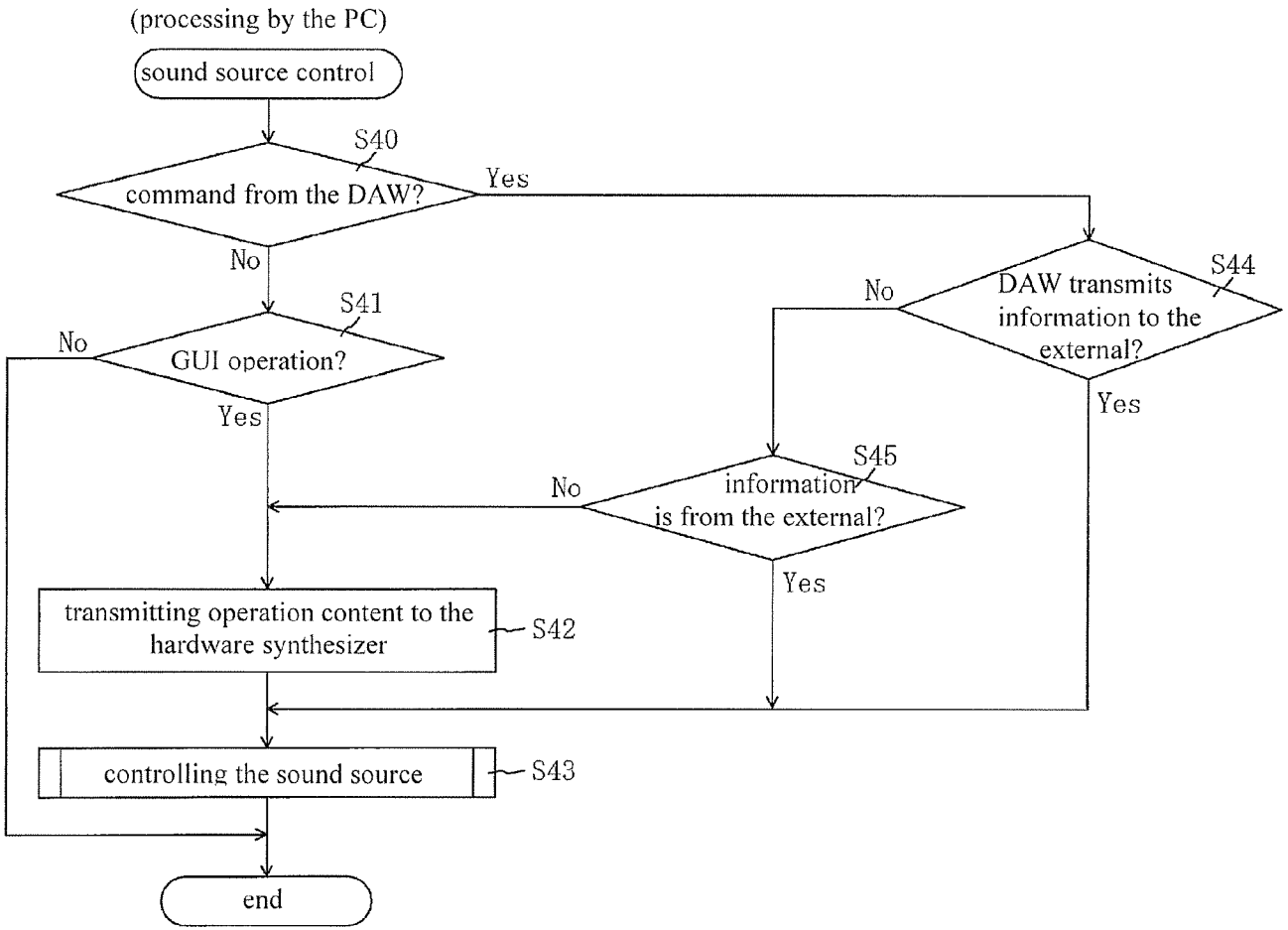
FIG. 10 is a flowchart showing a sound source control process performed by the PC.
Figure 11:
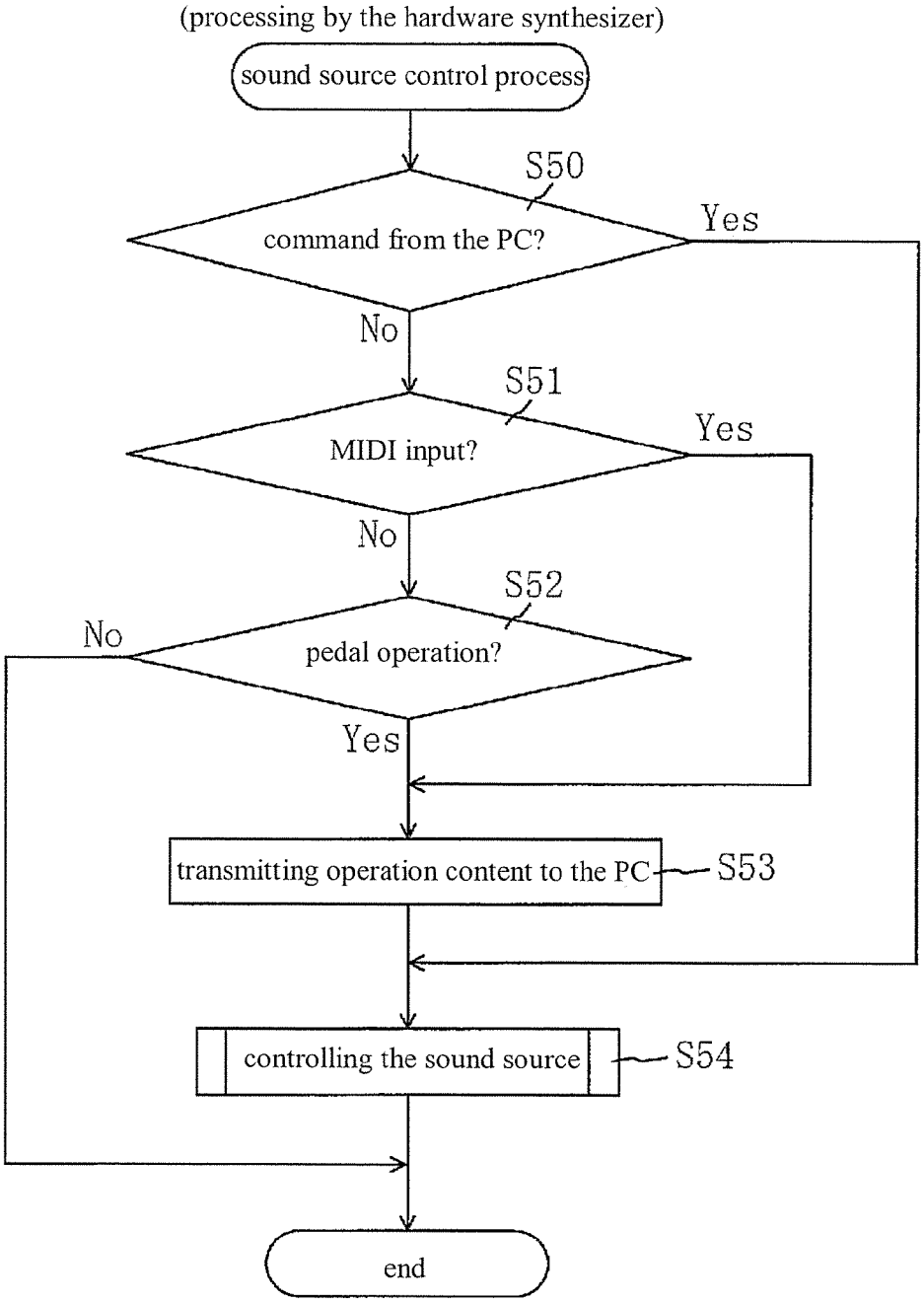
FIG. 11 is a flowchart showing a sound source control process performed by the hardware synthesizer.

In the sound source control processes illustrated in FIG. 10 and FIG. 11, the PC 10 and the hardware synthesizer 300 are always in the same state. In contrast thereto, in this embodiment, the first type synthesizer 200 displayed on the screen of the PC 10 is provided with a stand-alone operation mode setting button 289 as shown in FIG. 6(*a*) and the hardware synthesizer 300 is provided with a stand-alone operation mode setting button 403 as shown in FIG. 6(*b*).

The stand-alone operation mode setting buttons 289 and 403 are for setting the mode, in which the PC 10 and the hardware synthesizer 300 respectively generate musical sounds alone without exchanging information therebetween.

In this case, since the tone setting is performed independently with no influence on the other side, the tones of the PC 10 and the hardware synthesizer 300 may be different. Here, by playing the PC 10 and the hardware synthesizer 300 for comparison, which produces the better tone can be examined.

In other words, because two substantially the same devices are present simultaneously, they can be operated in turn for the operator to listen to and compare the subtle difference in tone. Then, data of the tone that is favorable is sent right away to the other (or the other way around), such that the favorable tone can be enjoyed on both devices thereafter. In order to listen to and compare the tones from both sides, for example, the audio data generated by the hardware synthesizer 300 may be sent to the PC 10 via the USB terminal 57 for the operator to listen to the tones and at the same time adjust the balance by the mixer in the DAW 18; or conversely, if the basic software 53 of the hardware synthesizer 300 or the second software synthesizer is capable of mixing the audio signal from the outside, the audio signal may also be sent from the PC 10 for the operator to listen by the hardware synthesizer 300. Certainly, it is also possible to input the respective outputs to an external mixer for listening and comparison.

Instead of not transmitting all the information, information related to the tone setting and information related to the normal performance operation, such as note-on, may be separated so as to transmit only one type of the information (or both may be sent to be selectively adopted at the receiving side).

The above illustrates the invention on the basis of the embodiments. However, it should be understood that the invention is not limited to any of the embodiments, and various modifications or alterations may be made without departing from the spirit of the invention.

In the above embodiment, the analog synthesizer 100 is emulated. However, the synthesizer to be emulated is not limited to the analog synthesizer 100. The synthesizer to be emulated may also be a digital synthesizer or a virtual synthesizer that does not exist.

In the above embodiment, the PC 10 and the hardware synthesizer 300 are connected via USB. However, the method for connecting the PC 10 and the hardware synthesizer 300 to communicate with each other is not limited to USB connection. They may also communicate via Ethernet or be connected by wireless communication such as Bluetooth and Wi-Fi.

The above embodiment illustrates the situation where the hardware synthesizer 300 is provided with the keyboard 60, but the invention is not limited thereto. For example, a synthesizer, which is the hardware synthesizer 300 with the keyboard 60 removed, may be connected to the PC 10 and then a keyboard may be connected to the PC 10.

In the above embodiment, the second software synthesizer 21 and the third software synthesizer 54 are used separately, but the invention is not limited thereto. The second software synthesizer 21 and the third software synthesizer 54 may be used at the same time. If a lot of operating elements are available, physically a portion thereof may input the input information to the second software synthesizer 21 and another portion thereof may input the input information to the third software synthesizer 54. In addition, the second software synthesizer 21 may run (command is supplied to the second software synthesizer 21) only when the user presses a switching button, and when the switching button is released, the third software synthesizer 54 runs (command is supplied to the third software synthesizer 54). Moreover, the second software synthesizer may be controlled by the PC 10 and the third software synthesizer 54 may be controlled by using the operating elements of the hardware synthesizer 300.

In the above embodiment, in the process of S41 of FIG. 10, the operation of the keyboard 12 and the mouse 13 is that the first software synthesizer 21 imports the information. However, the invention is not limited thereto. The DAW 18 may import information of the operation of the keyboard 12 and the mouse 13 to notify the first software synthesizer 21.

In the above embodiment, the hardware synthesizer 300 has a configuration different from the synthesizer 100 to be emulated and the existing synthesizers. However, the hardware synthesizer 300 may have the same configuration as other existing synthesizers if different from the synthesizer to be emulated.

Moreover, the above embodiment illustrates the example that when predetermined emulation of the analog synthesizer 100 is performed in both the PC 10 and the hardware synthesizer 300, emulation of the circuit operations thereof, configurations of the operating elements and the operation targets, or the ranges thereof are substantially equivalent. However, there may be situations where the same kind of plug-in software is used in a hardware configuration including CPU or in multiple PC environments of different OS, or the user wants to perform the same emulation on different types of hardware synthesizers, for example. Even in these situations, the software may be made considering the algorithm configuration or parameters of the respective emulation software in advance, so as to perform the predetermined emulation in the range that can achieve equivalent effects in any of the emulation environments. Thereby, emulation of the synthesizer 100 can always be performed to the same extent regardless of the difference of the PC or the hardware synthesizer.

Figure 9:
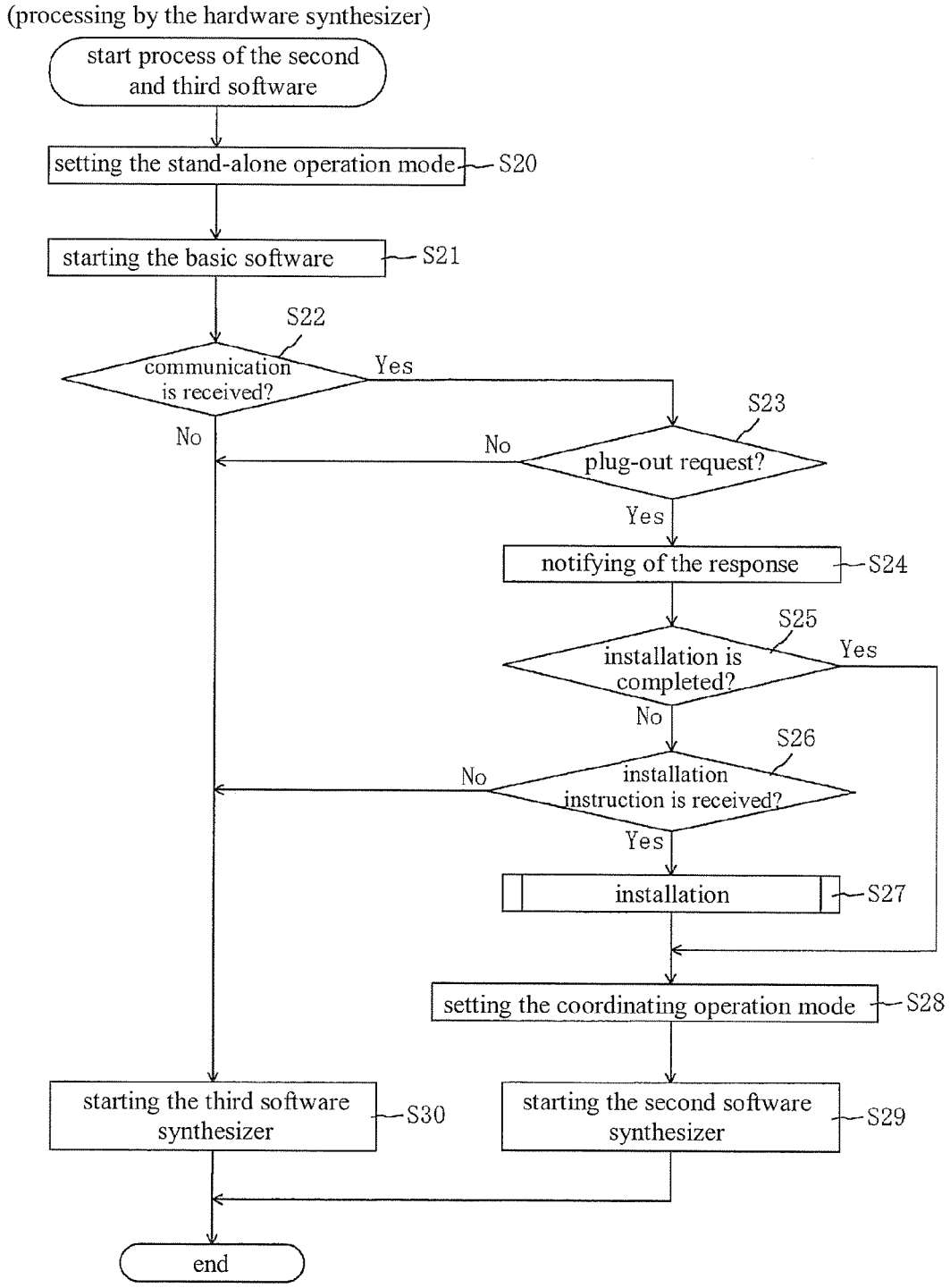
FIG. 9 is a flowchart showing a start process of the second and third software synthesizers.

Furthermore, in the above embodiment, in the start process of the second and third software synthesizers of FIG. 9, the second software synthesizer 21 is installed automatically, the coordinating operation mode is set automatically, and the second software synthesizer 21 is started automatically when the PC 10 and the hardware synthesizer 300 are connected. However, the invention is not limited thereto. For example, the installation of the second software synthesizer 21 may be executed on condition that the PLUG-OUT button 209 is pressed. Besides, in the case where the stand-alone operation mode is set by the stand-alone operation mode setting button 289, the stand-alone operation mode may be set. In the case where the mode of enabling the hardware synthesizer 300 to perform the original operation is set by the real machine mode button 398, the third software synthesizer may be started instead of the second software synthesizer.

What is claimed is:

1. An electronic musical instrument system, comprising:

an information processing device, which comprises a first CPU, a display displaying an image, a first input device inputting a first input information via the image displayed by the display, and first emulation software enabling the first CPU to emulate a predetermined electronic musical instrument comprising a plurality of input device based on the first input information inputted by the first input device;

an electronic musical instrument device, which comprises a second CPU, at least one second input device inputting a second input information via an operating element in a form different from the first input device, and non-emulation software enabling the second CPU to operate as an electronic musical instrument different from the predetermined electronic musical instrument based on the second input information inputted by the at least one second input device; and an electronic communication device connecting the information processing device and the electronic musical instrument device to communicate with each other, wherein the information processing device comprises:

a first memory device, which combines and stores the first emulation software and second emulation software enabling the second CPU to emulate the predetermined electronic musical instrument based on the second input information inputted by the at least one second input device;

the first CPU confirms whether the electronic musical instrument device corresponding to the second emulation software stored in the first memory device is connected to the information processing device via the electronic communication device; and the first CPU transfers the second emulation software stored in the first memory device to the electronic musical instrument device if the connection is confirmed by the first CPU, wherein the first emulation software and the second emulation software are related to emulations of the predetermined electronic musical instrument, and are configured to have the same function and to generate the same tone respectively.

2. The electronic musical instrument system according to claim 1, wherein:

the information processing device comprises the first CPU, which transmits the first input information inputted by the first input device to the electronic musical instrument device via the electronic communication device, wherein the electronic musical instrument device transfers the second emulation software via the first CPU;

the electronic musical instrument device transferring the second emulation software comprises the second CPU, which transmits the second input information inputted by the at least one second input device to the information processing device via the electronic communication device;

the first emulation software enables the first CPU to emulate the predetermined electronic musical instrument based on the second input information transmitted by the second CPU; and the second emulation software enables the second CPU to emulate the predetermined electronic musical instrument based on the first input information transmitted by the first CPU.

3. The electronic musical instrument system according to claim 2, wherein:

the information processing device comprises the first CPU, which prohibits the first input information inputted via the first input device from being transmitted to the electronic musical instrument device by the first CPU; and the electronic musical instrument device comprises the first CPU, which prohibits the second input information inputted via the at least one second input device from being transmitted to the information processing device by the second CPU.

4. The electronic musical instrument system according to claim 1, wherein:

the information processing device comprises a second memory device, which stores musical sound information generated by the first emulation software or a parameter related to a tone; and a first instruction switch, which inputs an instruction of transmitting the musical sound information or the parameter related to the tone stored in the second memory device from the information processing device to the electronic musical instrument device.

5. The electronic musical instrument system according to claim 1, wherein:

the electronic musical instrument device comprises a third memory device, which stores musical sound information generated by the second emulation software or a parameter related to a tone; and the information processing device comprises a second instruction switch, which inputs an instruction of transmitting the musical sound information or the parameter related to the tone stored in the third memory device from the electronic musical instrument device to the information processing device.

6. The electronic musical instrument system according to claim 1, wherein the first and second input information respectively inputted by the first input device and the at least one second input device is respectively limited to a same range.

7. The electronic musical instrument system according to claim 1, wherein:

the at least one second input device is a plurality of second input device;

the second emulation software enables the second CPU to operate based on the second input information inputted from a portion of the plurality of second input device; and the electronic musical instrument device comprises a signalling device, which distinguishably notifies the portion of the second input device and the other second input device when the second CPU is enabled to operate by the second emulation software.

8. The electronic musical instrument system according to claim 1, wherein the first input device displays an image, which emulates at least a portion of the input means of the predetermined electronic musical instrument, on the display.

9. The electronic musical instrument system according to claim 1, wherein the first input device displays an image, which emulates at least a portion of the second input device of the electronic musical instrument device, on the display.

10. The electronic musical instrument system according to claim 1, wherein the electric musical instrument device comprises a third instruction switch, which switches between a mode of enabling the second CPU to operate by the non-emulation software and a mode of enabling the second CPU to operate by the second emulation software.

11. The electronic musical instrument system according to claim 2, wherein the first CPU transmits the first input information inputted by the first input device, except for the second input information transmitted by the second CPU, to the electronic musical instrument device via the electronic communication device.

12. The electronic musical instrument system according to claim 2, wherein the second CPU transmits the second input information inputted by the second input device, except for the first input information transmitted by the first CPU, to the information processing device via the electronic communication device.

13. The electronic musical instrument system according to claim 1, wherein the first emulation software comprises plug-in software, which enables the first CPU to emulate the predetermined electronic musical instrument, or a software synthesizer, which enables the first CPU to emulate the predetermined electronic musical instrument.

14. The electronic musical instrument system according to claim 1, wherein the non-emulation software enables the electronic musical instrument device to operate as an independent electronic musical instrument different from the predetermined electronic musical instrument and an existing electronic musical instrument.

15. The electronic musical instrument system according to claim 1, wherein the second input device of the electronic musical instrument device is configured to be different from the input device of the predetermined electronic musical instrument in any of form, configuration, and number.

16. The electronic musical instrument system according to claim 1, wherein the electronic musical instrument device comprises a non-volatile fourth memory device, which stores the second emulation software transferred by the first CPU.

* * * * *